US008328662B2

(12) United States Patent
Nakamura et al.

(10) Patent No.: US 8,328,662 B2
(45) Date of Patent: Dec. 11, 2012

(54) GOLF CLUB HEAD

(75) Inventors: Takashi Nakamura, Kobe (JP); Masatoshi Yokota, Kobe (JP)

(73) Assignee: SRI Sports Limited, Kobe-Shi (JP)

( * ) Notice: Subject to any disclaimer, the term of this patent is extended or adjusted under 35 U.S.C. 154(b) by 277 days.

(21) Appl. No.: 12/762,019

(22) Filed: Apr. 16, 2010

(65) Prior Publication Data

US 2010/0304884 A1 Dec. 2, 2010

(30) Foreign Application Priority Data

May 28, 2009 (JP) ..... 2009-128370

(51) Int. Cl.
*A63B 53/04* (2006.01)

(52) U.S. Cl. ..... 473/330

(58) Field of Classification Search ..... 473/330
See application file for complete search history.

(56) References Cited

U.S. PATENT DOCUMENTS

| | | | | |
|---|---|---|---|---|
| 7,568,983 | B2 * | 8/2009 | Gilbert | 473/330 |
| 2003/0126734 | A1 | 7/2003 | Takeda | |
| 2007/0149312 | A1 | 6/2007 | Gilbert | |
| 2008/0032814 | A1 | 2/2008 | Ban | |
| 2008/0167138 | A1 | 7/2008 | Ban et al. | |
| 2008/0171613 | A1 | 7/2008 | Gilbert et al. | |
| 2009/0282670 | A1 | 11/2009 | Gilbert et al. | |
| 2009/0298609 | A1 | 12/2009 | Gilbert et al. | |
| 2009/0313806 | A1 | 12/2009 | Gilbert | |

FOREIGN PATENT DOCUMENTS

| | | | |
|---|---|---|---|
| JP | 9-70457 | A | 3/1997 |
| JP | 9-253250 | A | 9/1997 |
| JP | 10-179824 | A | 7/1998 |
| JP | 2002-153575 | A | 5/2002 |
| JP | 2007-7181 | A | 1/2007 |
| JP | 2008-161658 | A | 7/2008 |
| JP | 2010-240262 | * | 10/2010 |

* cited by examiner

*Primary Examiner* — Michael Dennis
(74) *Attorney, Agent, or Firm* — Birch, Stewart, Kolasch & Birch, LLP

(57) ABSTRACT

A head 2 has a face line 8 having a depth of D1 (mm). When a boundary between a land area and a face line is defined as a point Pa; a point of which a depth is [D1/4] (mm) is defined as a point Pb; a point of which a depth is [D1/2] (mm) is defined as a point Pc; a point of which a depth is [(D1)×(¾)] (mm) is defined as a point Pd; a point of which a depth is 0.002 (mm) is defined as a point Px; a radius of a circle CL1 passing through three points of the point Pa, the point Pb, and the point Pc is defined as R3 (mm); a straight line passing through the point Pa and the point Px is defined as a straight line Lax; and an angle between the land area and the straight line Lax is defined as θ2 (degree), the radius R3 is 0.2 (mm) or greater and 0.4 (mm) or less, and the angle θ2 is 10 degrees or greater and 50 degrees or less.

21 Claims, 17 Drawing Sheets

GOLF CLUB HEAD

This application claims priority on Patent Application No. 2009-128370 filed in JAPAN on May 28, 2009, the entire contents of which are hereby incorporated by reference.

BACKGROUND OF THE INVENTION

1. Field of the Invention

The present invention relates to a golf club head having face lines.

2. Description of the Related Art

Face lines are formed on many golf club heads. The face lines can contribute to increase in a backspin rate of a hitting ball. The face lines can suppress fluctuation in the backspin rate.

In golf in case of rain, a face impacts a ball with water present between the face and the ball. The water can reduce friction between the face and the ball. The face lines can suppress the influence of the water. In other words, the face lines can enhance spin performance in a wet condition.

In the case of shot from the rough, the face impacts the ball with grass (lawn grass) present between the face and the ball. The grass can reduce the friction between the face and the ball. The reduction in the friction may cause reduction in the backspin rate. A phenomenon in which the backspin rate is reduced is referred to as flier. The flier complicates the control of a flight distance. The face lines can contribute to the suppression of the flier. Since the grass is cut by the face lines, the flier can be suppressed.

On the other hand, the face lines may damage the ball. The damage includes also fine splitting. While the face lines having a sharp edge can contribute to increase in a spin rate, the face lines are apt to damage the ball.

Japanese Patent Application Laid-Open No. 2003-199851 (US2003/126734 A1) discloses a head having face lines with sharp edges, the head obtained by forming face lines in press processing, and carrying out cut processing of a face surface.

Japanese Patent Application Laid-Open No. 2008-36155 (US2008/032814 A1) discloses a golf club head having face lines having an edge to which a roundness having a radius of 0.2 mm or less is applied.

Japanese Patent Application Laid-Open No. 2007-7181 discloses an iron golf club set including a sand wedge and the other clubs, a curvature radius of an edge of a face line of the sand wedge being different from those of the other clubs.

Japanese Patent Application Laid-Open No. 2008-206984 (US2007/0149312 A1) discloses a shape of a face line capable of increasing a backspin rate.

SUMMARY OF THE INVENTION

When the edge is excessively round, the spin performance is apt to be decreased. On the other hand, when the edge is excessively sharp, the ball is apt to be damaged. It is difficult to realize both the spin performance and resistance to the damage of the ball. The damage of the ball may change a ball trajectory. The damage of the ball may influence the spin rate. The damage of the ball complicates the control of the hitting ball.

It is an object of the present invention to provide a golf club capable of enhancing the spin performance while suppressing the damage of the ball.

A golf club head according to the present invention includes: a face line having a depth of D1 (mm); and a land area. A boundary between the land area and the face line is defined as a point Pa in a section line of a surface of a face; a point of which a depth is [D1/4] (mm) is defined as a point Pb; a point of which a depth is [D1/2] (mm) is defined as a point Pc; a point of which a depth is [(D1)×(¾)] (mm) is defined as a point Pd; a point of which a depth is 0.002 (mm) is defined as a point Px; a radius of a circle CL1 passing through three points of the point Pa, the point Pb and the point Pc is defined as R3 (mm); a straight line passing through the point Pa and the point Px is defined as a straight line Lax; and an angle between the land area and the straight line Lax is defined as θ2 (degree). At this time, the radius R3 is 0.2 (mm) or greater and 0.4 (mm) or less, and the angle θ2 is 10 degrees or greater and 50 degrees or less.

Preferably, when a distance between a center of the circle CL1 and the land area LA is defined as L1 (mm), a ratio (L1/R3) is 0.76 or greater and 0.91 or less.

Preferably, the golf club head is manufactured by a manufacturing method including the following steps (A) and (B).

(1) (A) forming a face line fa having a depth of (D1+T1) (mm).

(2) (B) carrying out cut processing along a plane PL1 placed at a position of which a depth is T1 (mm) to form a face line fb having a depth of D1 (mm).

Preferably, an edge of the face line fa includes a protruded curved surface. Preferably, the plane PL1 crosses the protruded curved surface. Preferably, an intersection line of the plane PL1 and the protruded curved surface is a set of the points Pa.

A manufacturing method of a golf club head according to the present invention includes the following steps (A) and (B).

(1) (A) forming a face line fa having a depth of (D1+T1) (mm).

(2) (B) carrying out cut processing along a plane PL1 placed at a position of which a depth is T1 (mm) to form a face line fb having a depth of D1 (mm).

Preferably, an edge of the face line fa includes a protruded curved surface. Preferably, the plane PL1 crosses the protruded curved surface.

Preferably, the protruded curved surface is formed by cut processing using a cutter having a recessed curved surface in the step (A).

Both the suppression of the damage of the ball and the spin performance can be realized.

DESCRIPTION OF THE PREFERRED EMBODIMENTS

The present invention will be described below in detail based on preferred embodiments with reference to the drawings.

Figure 1:
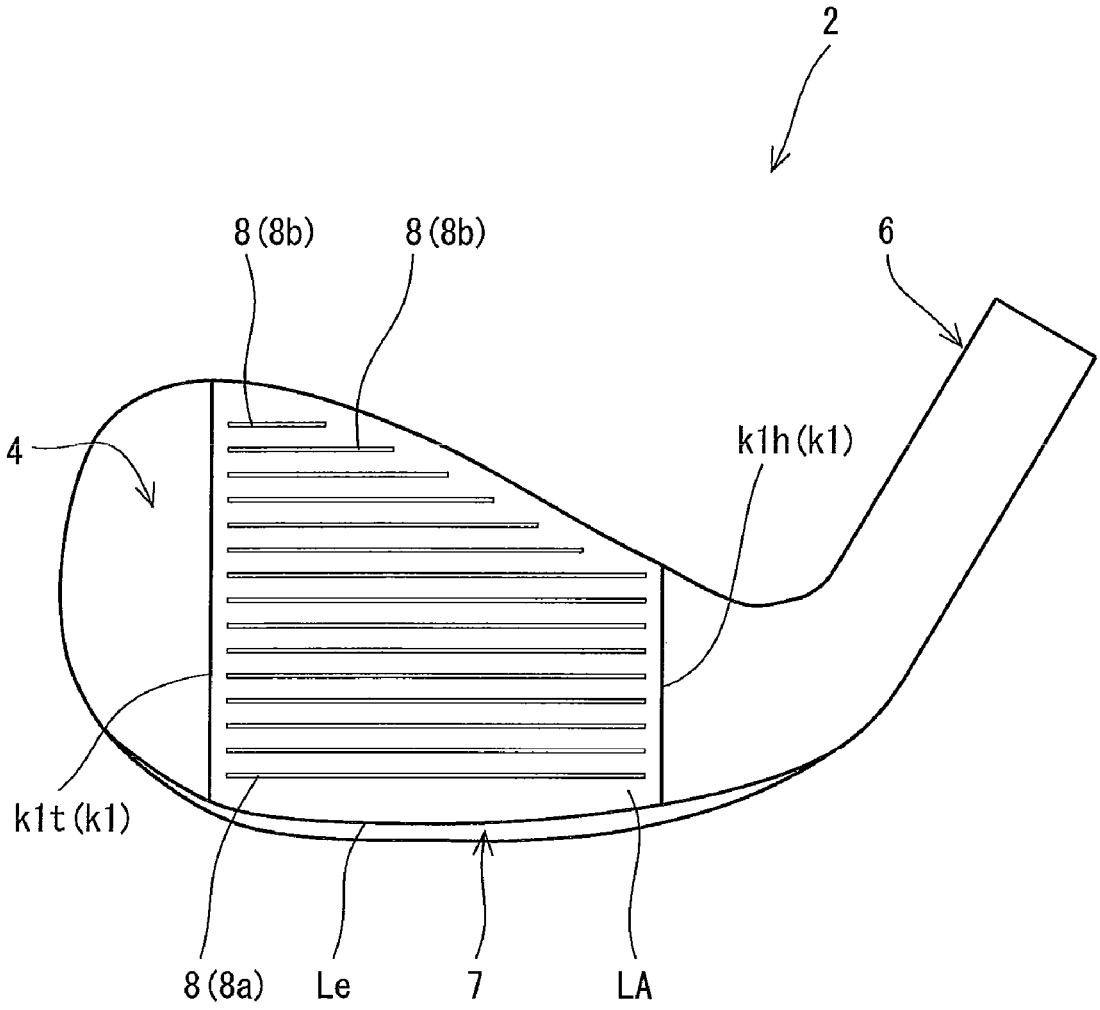
FIG. 1 is a diagram of a golf club head according to one embodiment of the present invention, as viewed from a face side.
Figure 2:
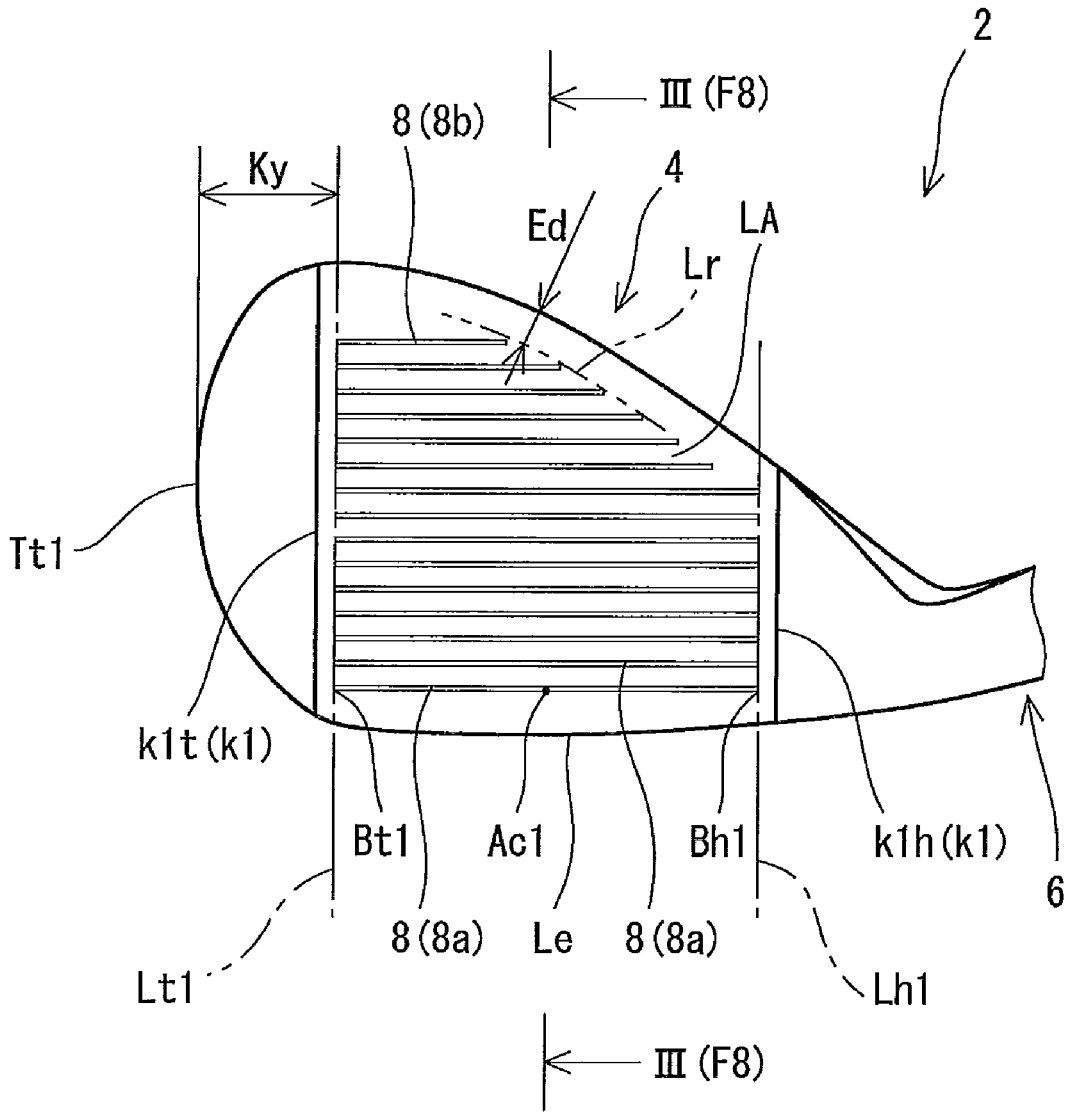
FIG. 2 is a diagram of the head of FIG. 1, as viewed from a position facing a face surface.

FIG. 1 is a diagram of a golf club head 2 according to one embodiment of the present invention, as viewed from a face side. In FIG. 1, the head 2 is placed on a level surface at a predetermined lie angle and real loft angle. FIG. 2 is a diagram of the head 2, as viewed from a position facing a face 4.

The golf club head 2 is a so-called iron type golf club head. The head is also referred to as an iron head. The head is for right-handed golfers. The golf club head 2 is a so-called wedge. The real loft angle of the wedge is usually 45 degrees or greater and 70 degrees or less.

The head 2 has a face 4, a hosel 6, and a sole 7. The face 4 has a face line 8 formed thereon. The golf club head 2 has a shaft hole (not shown) to which a shaft is mounted. The shaft hole is formed in the hosel 6.

A material of the head 2 and the face 4 is not restricted. The face 4 may be a metal, or may be a nonmetal. Examples of the metal include iron, stainless steel, maraging steel, pure titanium, and a titanium alloy. Examples of the iron include soft iron (a low carbon steel having a carbon content of less than 0.3 wt %). Examples of the nonmetal include CFRP (carbon fiber reinforced plastic). The surface of the face 4 may be subjected to surface treatments such as plating and coating painting.

The head 2 has the plurality of face lines 8. The face lines 8 are grooves. In the present application, the face lines 8 are also referred to as grooves. The face lines 8 are constituted by the longest lines 8*a* having the longest length and non-longest lines 8*b* shorter than the longest lines 8*a*. The lengths of the non-longest lines 8*b* are shorter as getting closer to a top side.

Toe side ends of the longest lines 8*a* are substantially located on one straight line Lt1 (see FIG. 2). Heel side ends of the longest lines 8*a* are substantially located on one straight line Lh1 (see FIG. 2). The straight line Lt1 and the straight line Lh1 are shown by a one-dotted chain line in FIG. 2.

Toe side ends of the non-longest lines 8*b* are substantially located on one straight line Lt1, or are located on the heel side relative to the straight line Lt1. In the head 2 of the embodiment, the toe side ends of all the non-longest lines 8*b* are substantially located on one straight line Lt1. The toe side ends of the non-longest lines 8*b* may be located on the heel side relative to the straight line Lt1.

Heel side ends of the non-longest lines 8*b* are substantially located on one straight line Lh1, or are located on the toe side relative to the straight line Lh1. Usually, the heel side ends of the non-longest lines 8*b* are located on the toe side relative to the straight line Lh1 as in the embodiment of FIG. 2. The heel side ends of the non-longest lines 8*b* are located on a line Lr (see FIG. 2) almost along the contour of the face 4. A distance Ed (see FIG. 2) between each of the heel side ends of the non-longest lines 8*b* and an edge of the face 4 is almost constant.

The face 4 has a land area LA. The land area LA indicates a portion of a surface (face surface) of the face 4 on which the grooves are not formed. If fine unevenness formed by a shot-blasting treatment or the like to be described later is disregarded, the land area LA is substantially a plane. When a section shape is considered in the present application, the land area LA shall be a plane.

Apart of the face 4 is subjected to a treatment for adjusting a surface roughness. The typical example of the treatment i the shot-blasting treatment. The treatment will be described later. A boundary line k1 between an area which is subjected to the shot-blasting treatment and an area which is not subjected to the shot-blasting treatment is shown in FIGS. 1 and 2. An area between a toe side boundary line k1*t* and a heel side boundary line k1*h* is subjected to the shot-blasting treatment. All the face lines 8 are formed in the area which is subjected to the shot-blasting treatment. A toe side area relative to the toe side boundary line k1*t* is not subjected to the shot-blasting treatment. A heel side area relative to the heel side boundary line k1*h* is not subjected to the shot-blasting treatment. The toe side boundary line k1*t* and the heel side boundary line k1*h* are visually recognized by the absence or presence of the shot-blasting treatment. The shot-blasting treatment can increase the surface roughness. The increased surface roughness can increase the backspin rate of a ball. The increase in the backspin rate tends to stop the ball near the point of fall. The increase in the backspin rate can facilitate the stopping of the ball at the aiming point. The increase in the backspin rate is particularly useful for a shot targeting a green and an approach shot.

As shown in FIG. 2, the straight line Lt1 and the boundary line k1*t* are substantially parallel. The straight line Lh1 and the boundary line k1*h* are substantially parallel. The straight line Lt1, the boundary line k1*t*, the straight line Lh1, and the boundary line k1*h* are substantially parallel.

The toe side boundary line k1*t* is located on the toe side of the straight line Lt1. The heel side boundary line k1*h* is located on the heel side of the straight line Lh1.

The face surface may be polished before processing the face lines 8. The face surface of a head 2*p* before the face lines 8 are formed can be smoothed by polishing the face surface.

The face surface may be polished after processing the face lines 8. The land area LA can be flattened by polishing the face surface. A roundness may be applied to the edge of the face line 8 by the polishing. As described later, it is preferable that cut processing of the face surface is carried out after processing the face lines 8.

A treatment (the shot-blasting treatment described above, or the like) for adjusting a surface roughness may be carried out before processing the face lines 8. The treatment for adjusting the surface roughness may be carried out after processing the face lines 8

Figure 3:
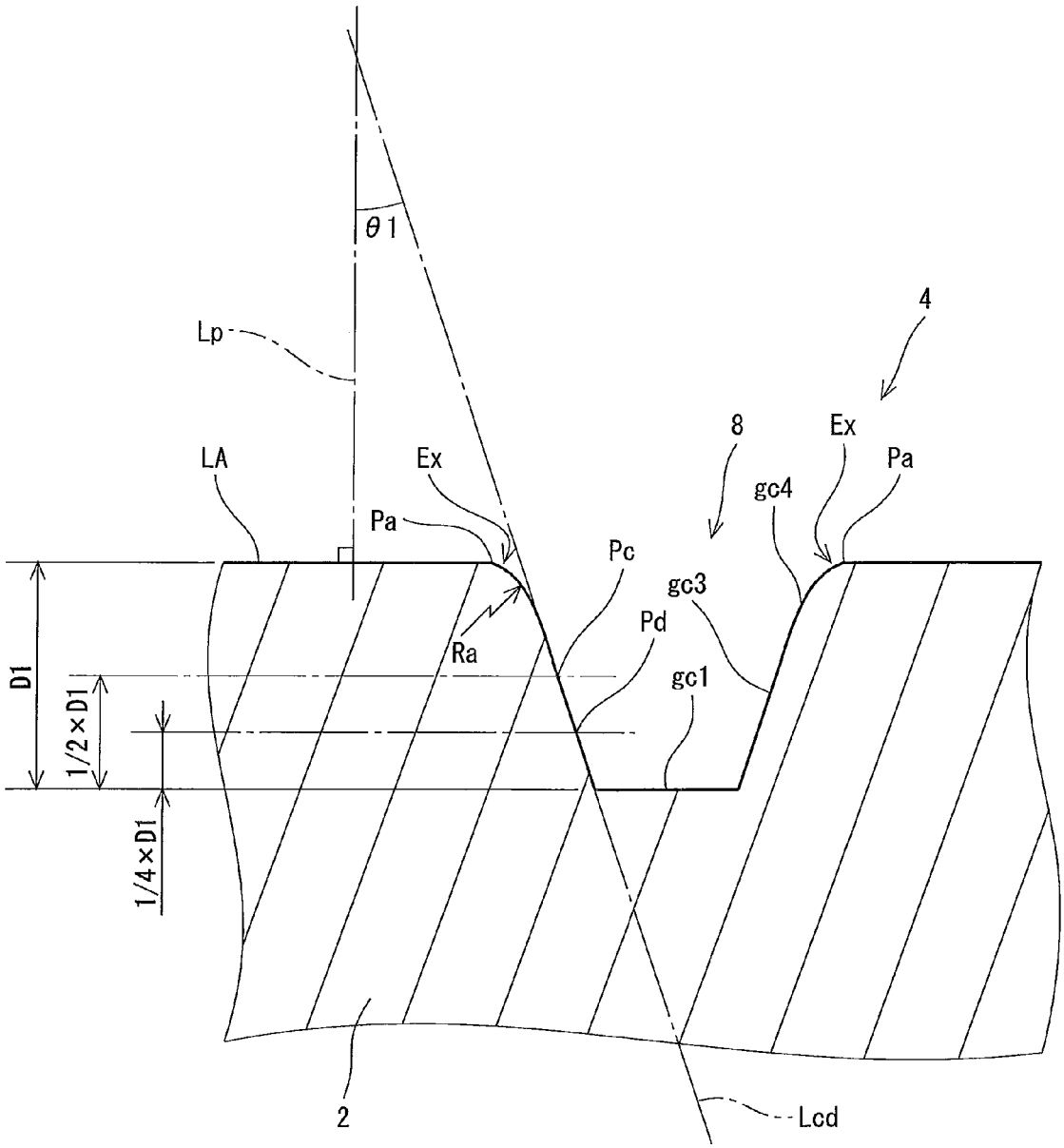
FIG. 3 is a diagram in which a part of a section taken along a line of FIG. 2 is expanded.

FIG. 3 is a sectional view taken along a line of FIG. 2. FIG. 3 is an enlarged view showing only one face line 8.

As shown in FIG. 3, the face line 8 has a bottom surface gc1, a plane inclined part gc3, and a protruded curved surface gc4. The whole or a part of the protruded curved surface gc4 is an edge Ex.

The bottom surface gc1 is a plane. The plane is parallel to the land area LA. The bottom surface gc1 may not be a plane. For example, the bottom surface gc1 may be a curved surface, or may be an inclined surface. In respect of enlarging an area A1 (described later) of a transverse plane of a groove to enhance spin performance, the bottom surface gc1 is preferably a plane.

The plane inclined part gc3 may be present, or may not be present. In respect of enlarging the area A1 (described later) of the transverse plane of the groove to enhance the spin performance, it is preferable that the plane inclined part gc3 is present.

Figure 4:
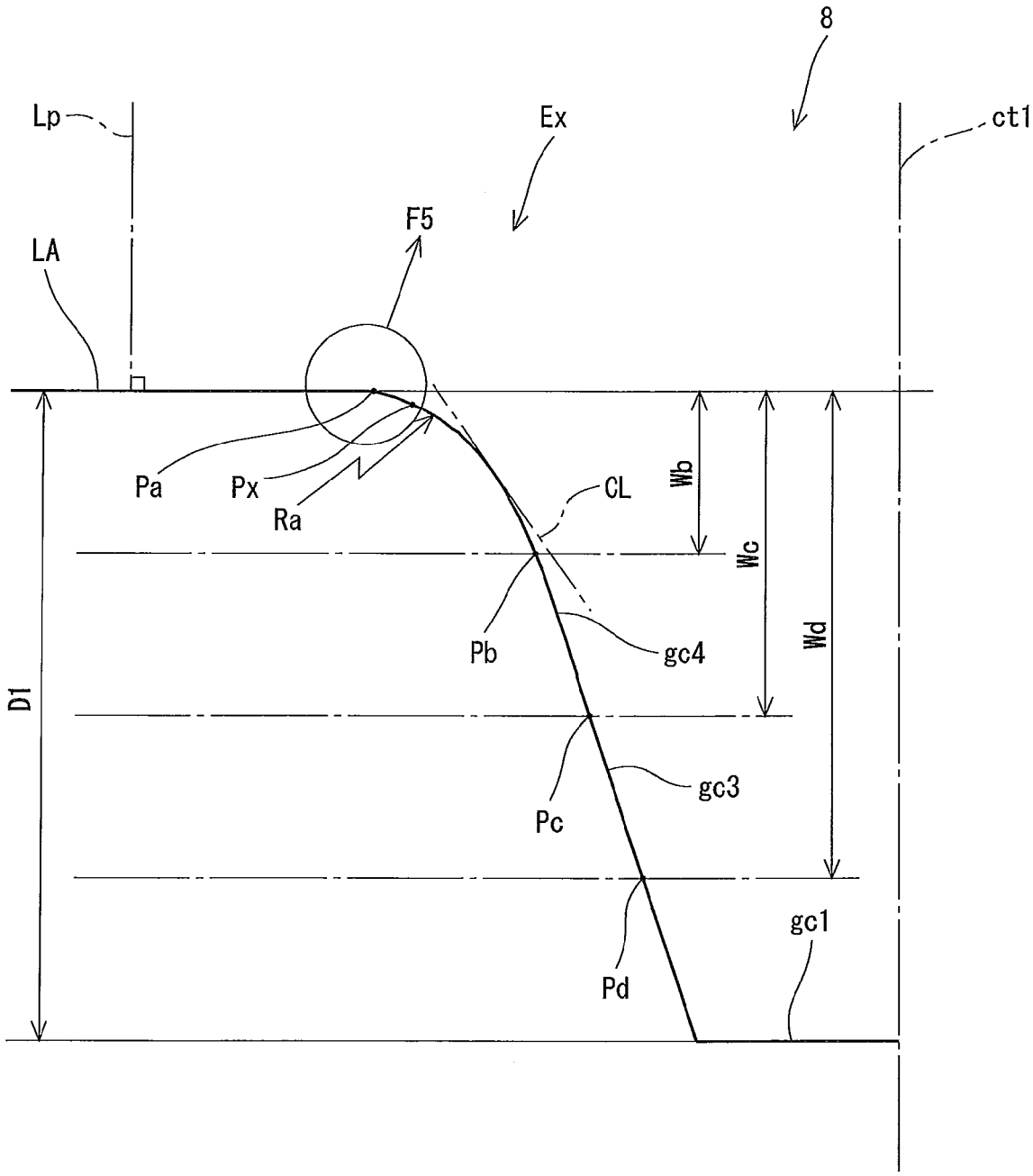
FIG. 4 is a diagram in which a section line of FIG. 3 is expanded.
Figure 5:
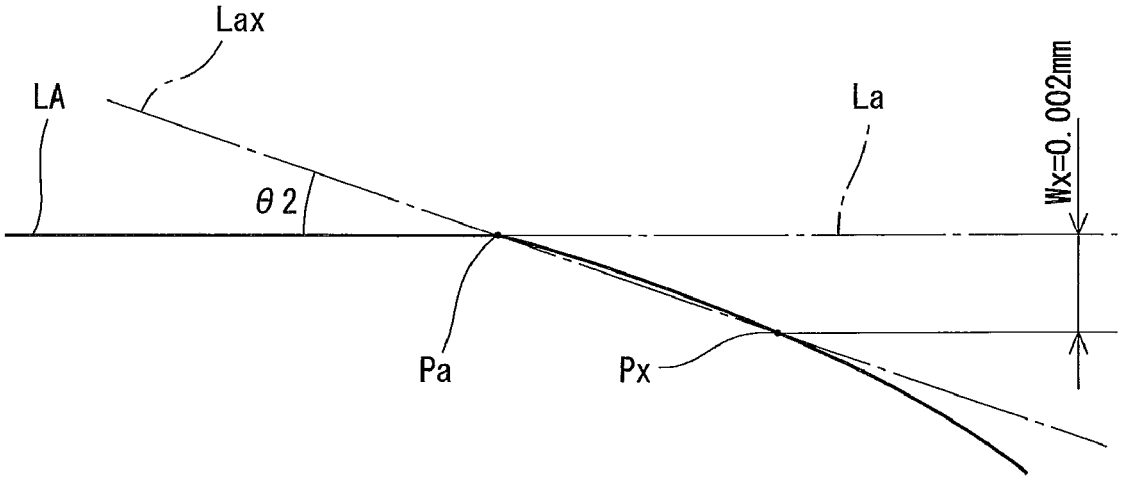
FIG. 5 is a diagram in which an inside of a circle of FIG. 4 is expanded.
Figure 6:
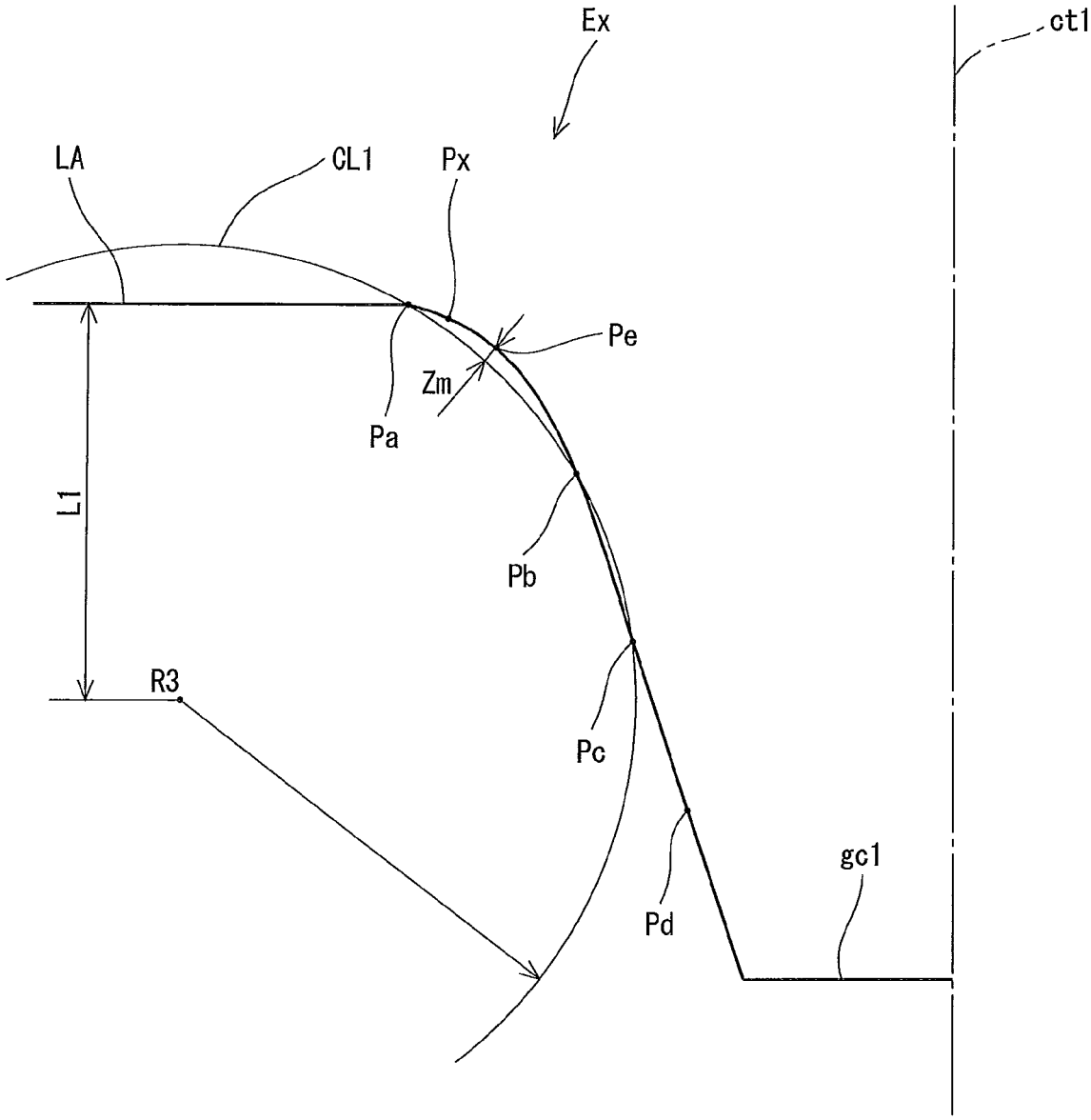
FIG. 6 is a diagram in which the section line of FIG. 3 is expanded as in FIG. 4.

FIGS. 4 and 6 are enlarged views showing a section line of a surface of the face line 8. FIG. 5 is an enlarged view of an inside of a circle of FIG. 4. The section shape of the face line 8 is symmetrical. The section shape of the face line 8 is axisymmetric about a central line ct1. Only the left side portion of the central line ct1 is shown in FIGS. 4 and 6.

In the present application, the section line of the surface of the face line or the section line of the surface of the land area LA is merely also referred to as a "section line".

In the embodiment, the protruded curved surface gc4 and the land area LA are not smoothly continuously formed. A point which is not smoothly continuously formed is a point Pa. The point Pa will be described in detail later. The protruded curved surface gc4 and the land area LA may be smoothly continuously formed. The face line 8 and the land area LA may be smoothly continuously formed. The section line may be smoothly continuously formed at the point Pa. In respect of the spin performance, it is preferable that the protruded curved surface gc4 and the land area LA are not smoothly continuously formed. In respect of the spin performance, it is preferable that the section line is not smoothly continuously formed.

The protruded curved surface gc4 and the plane inclined part gc3 are smoothly continuously formed. The protruded curved surface gc4 and the plane inclined part gc3 may not be smoothly continuously formed.

In the present application, a point Pa, a point Pb, a point Pc, and a point Pd are defined. The point Pa, the point Pb, the point Pc, and the point Pd are points present on the surface of the face line 8. The point Pa, the point Pb, the point Pc and the point Pd are points present on the section line of the surface of the face line 8.

An upper end point of the edge Ex of the face line 8 is the point Pa (see FIG. 4). The point Pa is a boundary between the land area LA and the face line 8.

A groove depth (mm) is shown by a double-pointed arrow D1 in FIG. 4. The groove depth D1 is a distance between the deepest point of the bottom surface gc1 and the land area LA. The groove depth D1 is a distance between the deepest point of the face line 8 and the land area LA. The groove depth D1 is measured along a direction (a direction of the straight line Lp) perpendicular to the land area LA.

A point placed at a position of which a depth is ¼ of the groove depth D1 is the point Pb (see FIG. 4). In other words, a depth Wb of the point Pb is [D1/4] (mm).

A point placed at a position of which a depth is ½ of the groove depth D1 is the point Pc (see FIG. 4). In other words, a depth Wc of the point Pc is [D1/2] (mm).

A point placed at a position of which a depth is ¾ of the groove depth D1 is the point Pd (see FIG. 4). In other words, a depth Wd of the point Pd is [(D1)×(¾)] (mm).

In the present application, the point Px is defined. The point Px is a point on the surface of the face line 8. The point Px is a point on the section line of the surface of the face line 8.

A point placed at a position of which a depth is 0.002 (mm) is the point Px (see FIG. 5). In other words, a depth Wx of the point Px is 0.002 (mm).

The depth Wx, the depth Wb, the depth Wc, and the depth Wd are measured along a direction perpendicular to the land area LA.

An angle between the straight line Lax and the land area LA is shown by θ2 in FIG. 5. The straight line Lax is a straight line passing through the point Pa and the point Px.

The angle θ2 shows a substantial angle of the edge Ex or an approximate value of the angle at the point Pa. The degree of the sharpness of the edge Ex at the point Pa is clearly shown by determining the point Px separated by a minute distance from the point Pa and considering the straight line Lax passing through the point Px and the point Pa. The point Px is a point defined in order to clarify the degree of the sharpness of the edge Ex at the point Pa.

In the present application, the angle θ2 is considered. In respect of the spin performance, the angle θ2 is preferably equal to or greater than 10 degrees, more preferably equal to or greater than 15 degrees, still more preferably equal to or greater than 20 degrees, still more preferably equal to or greater than 22 degrees, still more preferably equal to or greater than 25 degrees, and particularly preferably equal to or greater than 28 degrees. In respect of suppressing the damage of the ball, the angle θ2 is preferably equal to or less than 50 degrees, more preferably equal to or less than 40 degrees, still more preferably equal to or less than 38, and particularly preferably equal to or less than 34 degrees.

In the present application, a radius R3 is defined.

The radius R3 is a radius of a circle CL1 passing through the point Pa, the point Pb, and the point Pc (see FIG. 6). A part of circle CL1 is drawn in FIG. 6. The radius of the circle CL1 is R3 (mm).

In respect of enlarging the area A1 of the transverse plane of the groove to enhance dischargeability of water, and dischargeability of earth and sand, the radius R3 is preferably equal to or less than 0.4 (mm), more preferably equal to or less than 0.33 (mm), still more preferably equal to or less than 0.31 (mm), and particularly preferably equal to or less than 0.29 (mm). In respect of suppressing the damage of the ball, the radius R3 is preferably equal to or greater than 0.2 (mm), more preferably equal to or greater than 0.23 (mm), still more preferably equal to or greater than 0.25 (mm), and particularly preferably equal to or greater than 0.26 (mm).

The dischargeability of water implies the degree of the removal of water interposed between the face and the ball. The water can reduce the spin performance. A groove having good dischargeability of water can enhance the spin performance in a wet condition.

The dischargeability of earth and sand implies the degree of the removal of earth and sand, and mud interposed between the face and the ball. The earth and sand, and the mud can reduce the spin performance. Particularly, amateur golf players are given to duff a ball. In the duffing shot, the earth and sand or the like hit the face right before impact. The earth and sand or the like may intrude into the face line. The earth and sand, and the mud are apt to reduce the spin performance. A groove having good dischargeability of earth and sand can be excellent in the spinperformance in the duffing shot. The groove having good dischargeability of earth and sand can be excellent also in the spin performance in sand shot.

The maximum value of a deviation distance between the section line of the point Pa to the point Pc and the circle CL1 is shown by a double-pointed arrow Zm in FIG. 6. The maximum deviation distance Zm is measured along the radial direction of the circle CL1.

In respect of enhancing the effect resulting from the definition of the radius R3, the maximum deviation distance Zm is preferably equal to or less than 0.05 (mm), more preferably equal to or less than 0.03 mm, and still more preferably equal to or less than 0.02 (mm).

In the embodiment of FIG. 6, a point Pe bringing about the maximum distance Zm is located between the point Pa and the point Pb. The constitution can suppress excessive reduction in curvature radii in the point Pa and the point Pc. The constitution can suppress the damage of the ball.

The curvature radius Ra of the section line between the point Pa and the point Px may be constant, or may varied. Hereinafter, the minimum value of the curvature radius Ra of the section line between the point Pa and the point Px is defined as Ra1 (mm). When the section line between the point Pa and the point Px is close to a straight line, the point Pa is close to a sharpened condition, whereby the spin performance tends to be enhanced. In respect of the spin performance, it is preferable that the minimum value Ra1 is larger than the radius R3.

A straight line passing through the point Pc and the point Pd is shown by a one-dotted chain line Lcd in FIG. 3. An angle between the straight line Lp perpendicular to the land area LA and the straight line Lcd is shown by θ1 in FIG. 3. The angle θ1 is measured in the section of the face line 8. In the present application, the angle θ1 is also referred to as a groove angle.

When the groove angle θ1 is excessive, the area A1 (described later) of the transverse plane of the groove is apt to be excessively reduced. When the area A1 of the transverse plane of the groove is excessively small, the dischargeability of water is apt to be reduced. In respect of the spin performance in the wet condition, the groove angle θ1 is preferably equal to or less than 30 degrees, more preferably equal to or less than 25 degrees, and still more preferably equal to or less than 20 degrees.

When the groove angle θ1 is excessively small, it may be difficult to process the groove. In this respect, the groove angle θ1 is preferably equal to or greater than 1 degree, more preferably equal to or greater than 3 degrees, and still more preferably equal to or greater than 5 degrees.

Both the spin performance and the damage of the ball are realized by setting the radius R3 and the angle θ2 to the values described above. The suitable radius R3 suppresses the damage of the ball. The suitable angle θ2 can enhance the spin performance.

The curvature radius Ra at each of the points between the point Pa and the point Pb may be constant, or may not be constant. In respects of the damage of the ball, the dischargeability of water, and the dischargeability of earth and sand, it is preferable that the curvature radius Ra at each of the points between the point Pa and the point Pb is gradually increased as approaching to the point Pa. Although the straight line portion may be included between the point Pa and the point Pb, in respects of the damage of the ball, the dischargeability of water, and the dischargeability of earth and sand, it is preferable that the straight line portion is not included between the point Pa and the point Pb. In respects of the damage of the ball, the dischargeability of water, and the dischargeability of earth and sand, it is preferable that only a curved line is included between the point Pa and the point Pb. In respects of the damage of the ball, the dischargeability of water, and the dischargeability of earth and sand, it is preferable that a convex shape toward the central line ct1 of the face line is included between the point Pa and the point Pb.

The curvature radius Ra at each of the points between the point Pa and the point Pc may be constant, or may not be constant. The straight line portion may be included between the point Pa and the point Pc. In respects of the damage of the ball, the dischargeability of water, and the dischargeability of earth and sand, it is preferable that only a curved line is included between the point Pa and the point Pc.

The curvature radius Ra at each of the points between the point Pb and the point Pc may be constant, or may not be constant. The straight line portion may be included between the point Pb and the point Pc.

The curvature radius Ra at each of the points between the point Pc and the point Pd may be constant, or may not be constant. The straight line portion may be included between the point Pc and the point Pd. Only the straight line may be included between the point Pc and the point Pd.

In respects of the damage of the ball, the dischargeability of water, and the dischargeability of earth and sand, it is preferable that the point Pa to the point Pd is smoothly continuously provided. It is preferable that the straight line and/or the curved line are smoothly continuously provided between the point Pa and the point Pd.

In respects of the damage of the ball, the dischargeability of water, and the dischargeability of earth and sand, it is preferable that a tangent CL is present in all the points (excluding the point Pa and the point Pb) between the point Pa and the point Pb. An example of the tangent CL is shown in FIG. 4.

A formation method of the face line is not restricted. As the formation method of the face line, forging, press processing, casting, and cutting processing (carving) are exemplified.

In the cutting processing, the cutting processing of the face line is carried out using the cutter. In the press processing, a face line mold which has a protruded part corresponding to the shape of the face line is used. The face line mold is forced on the face, and the face line is formed. The face line mold in the press processing may be referred to as a "face line engraved mark" by a person skilled in the art.

In the case of the press processing, the expense of the face line mold is inexpensive, and maintenances such as correction are also easy. On the other hand, in the case of the press processing, a receiving jig for supporting the back side of the head is required. High accuracy is required for the receiving jig.

Since the face line is also formed in the casting while the head is cast, there is less time and effort for forming the face line. However, the molten metal stream during the casting may cause a defect in the face line.

In respect of the accuracy of the section shape of the face line, it is most preferable that the face line is formed by the cut processing.

In the cut processing, the edge of the face line is apt to be excessively sharp. The edge is apt to damage the ball. In this respect, processing for rounding the edge may be carried out after the cut processing. Buff and shot blasting are exemplified as processing for rounding the edge. The buff is carried out, for example, by a wire brush. When processing for rounding the edge is carried out after the cut processing, the variation in the section shape of the face line is apt to occur. In this respect, the edge may be rounded by the cut processing. In respect of the accuracy of the section shape of the face line, it is preferable that the edge is rounded by the cut processing. More specifically, it is preferable that the edge is rounded while the face line is formed by the cut processing. An example of the embodiment in which the edge is rounded while the face line is formed by the cut processing is a step (A) to be described later. Another example of the embodiment in which the edge is rounded while the face line is formed by the cut processing is an embodiment shown in FIG. 14. These embodiments will be described later.

A preferred manufacturing method of a golf club head includes the following steps (A) and (B).

The step (A) is a step of forming a face line fa having a depth of (D1+T1) (mm).

The step (B) is a step of carrying out cut processing along a plane PL1 placed at a position of which a depth is T1 (mm) to form a face line fb having a depth of D1 (mm).

Figure 7:
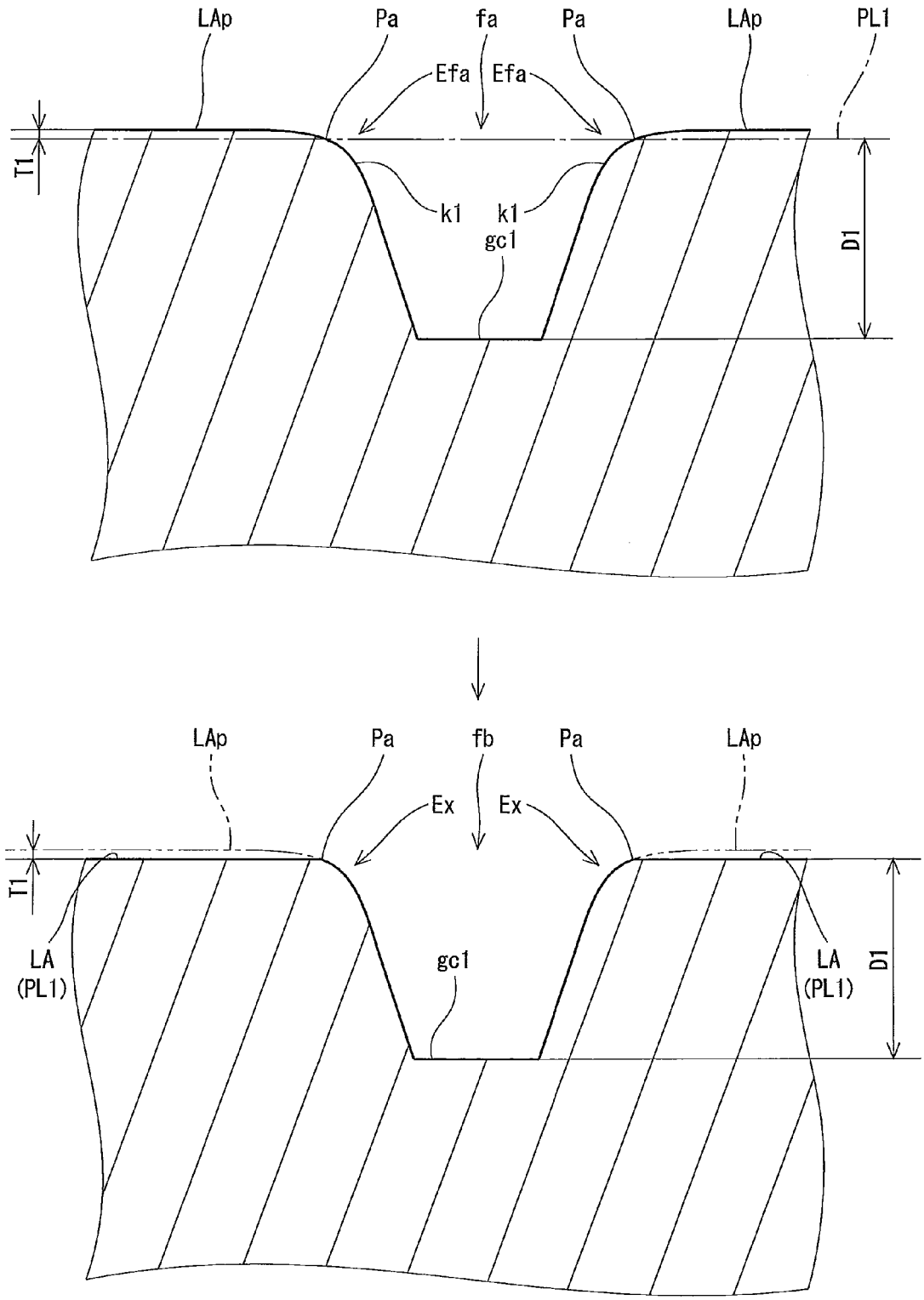
FIG. 7 is a diagram for explaining one example of a manufacturing method according to the present invention.
Figure 8:
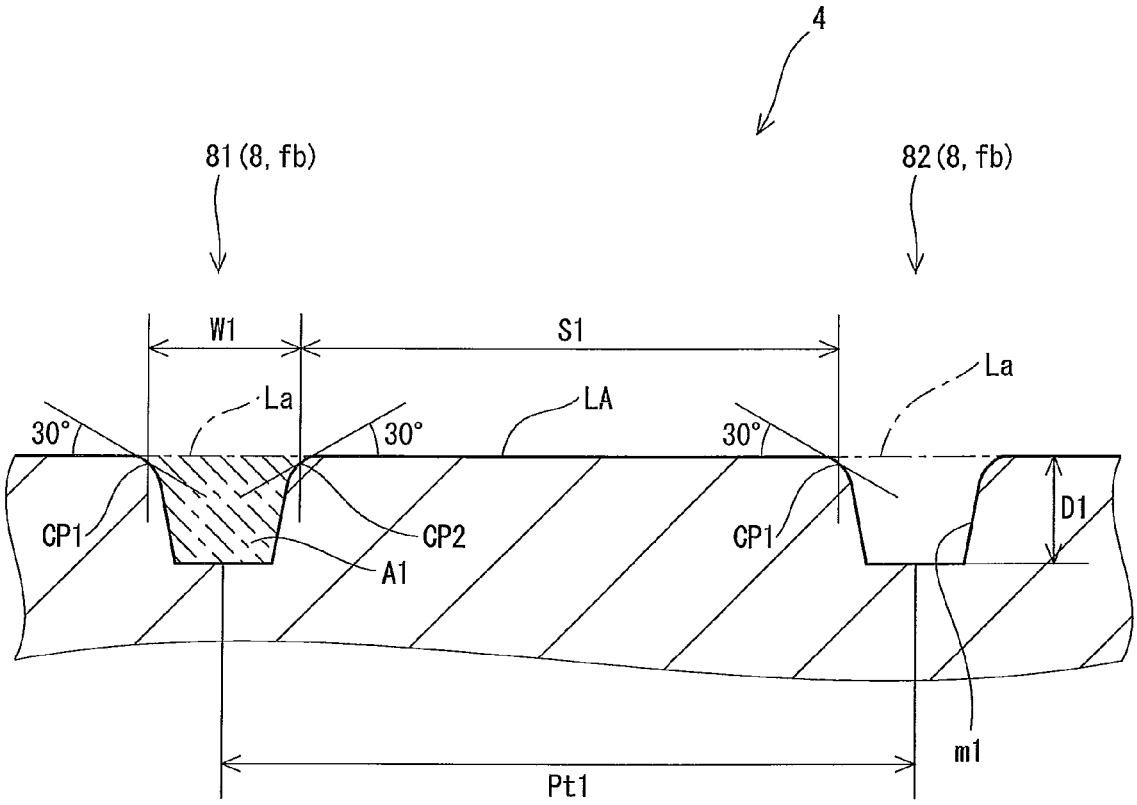
FIG. 8 is a diagram in which a part of a section taken along a line F8-F8 of FIG. 2 is expanded.

FIG. 7 is a diagram for explaining an example of a manufacturing method including the steps (A) and (B). FIG. 8 is a sectional view of the face 4 obtained through the steps (A) and (B). Two adjacent face lines 8 (face lines fb) are shown in FIG. 8.

Hereinafter, a preferred manufacturing method will be described with reference to FIG. 7. In the preferred manufacturing method, first, the face line fa having a depth of (D1+T1) (mm) is formed in the step (A). The face line fa is shown in an upper diagram of FIG. 7. A plane portion between the face line fa and the face line fa is a land area LAp.

The step (B) is carried out after the step (A). In the step (B), the cut processing is carried out along the plane PL1 placed at a position of which a depth is T1 (mm). The plane PL1 is shown by a one-dotted chain line in an upper diagram of FIG. 7. In the step (B), the face line fb having a depth of D1 (mm) is formed. The face line fb is shown in a lower diagram of FIG. 7. The land area LA is formed at the position of the plane PL1 in the step (B). More specifically, the plane PL1 is a plane including the land area LA.

The face line fb formed in the step (B) is a face line of the completed head. More specifically, the face line fb is the face line 8. The depth of the face line fb is D1 (mm). The depth of the face line fb is shallower than that of the face line fa. A difference between the depth of the face line fa and the depth of the face line fb is T1 (mm). The depth of the face line fa is reduced in the step (B) to form the face line fb.

An edge Efa of the face line fa includes a protruded curved surface K1 (see the upper diagram of FIG. 7).

As shown in the upper diagram of FIG. 7, the plane PL1 crosses the protruded curved surface K1. More specifically, a curved line showing the protruded curved surface K1 crosses a straight line showing the plane PL1 in the sectional view of FIG. 7. An intersection of the curved line showing the protruded curved surface K1 and the straight line showing the plane PL1 is the point Pa. More specifically, a set of the points Pa is the intersection line of the plane PL1 and the protruded curved surface.

The face line having the radius R3 and the angle θ2 having the numerical value ranges can be formed with sufficient accuracy in the manufacturing method including the steps (A) and (B).

The method of the step (A) is not restricted. As described above, as the step (A), the forging, the press processing, the casting, and the cutting processing (carving) are exemplified. The details of these methods are described above.

The preferred step (A) is the cut processing. The preferred embodiment of the cut processing is cut processing using the cutter having the recessed curved surface.

Figure 9:
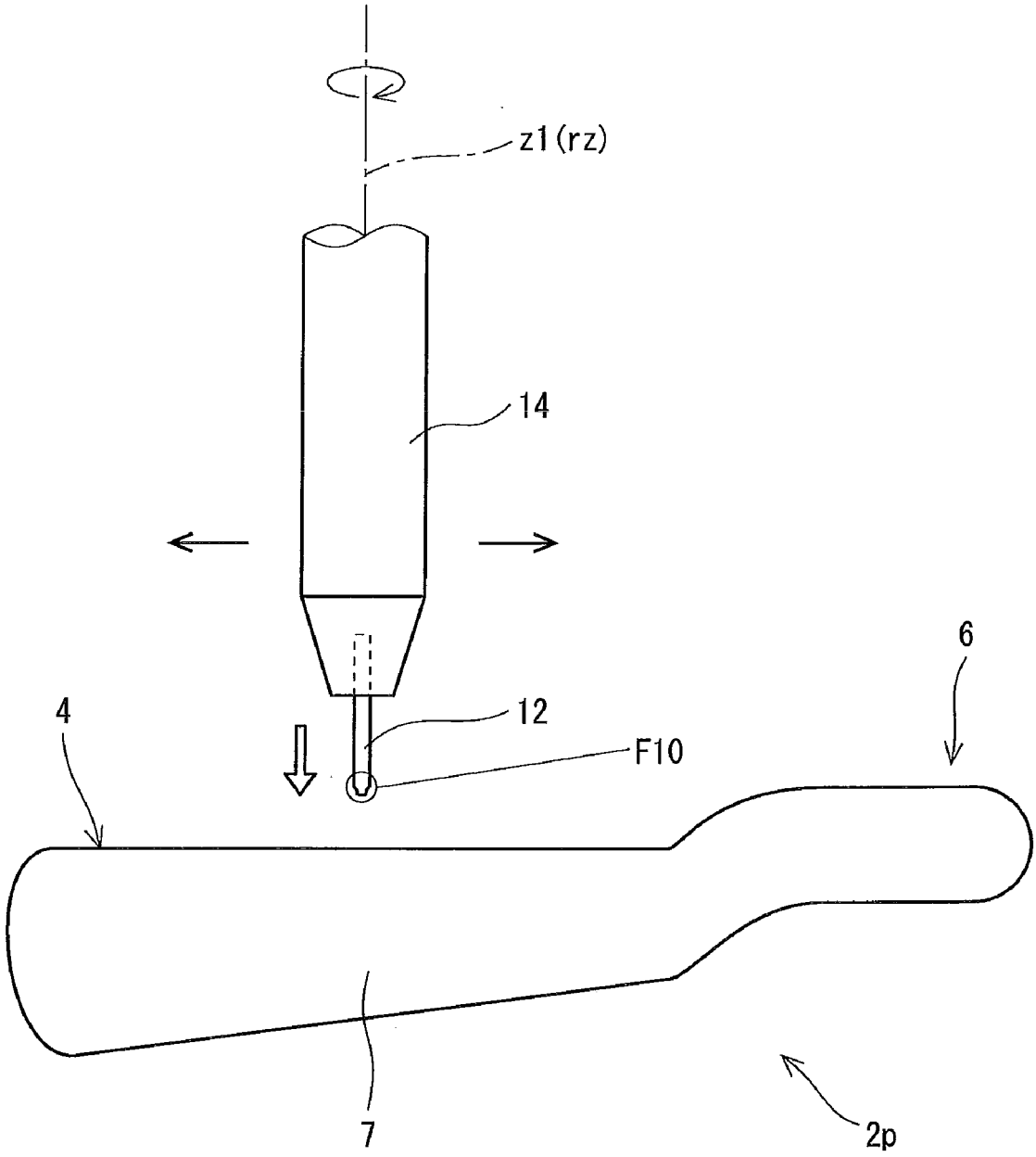
FIG. 9 is a diagram for explaining cut processing by a cutter.

An example of the preferred step (A) will be described below. FIG. 9 is a diagram for explaining an example of the step of processing the face line fa. The step can be conducted by, for example, using an NC processing machine. NC implies numerical control. In respect of processing accuracy, a more preferable NC processing machine is a CNC processing machine. CNC implies "computerized numerical control".

In the step, first, the head 2*p* before the face line fa is formed is prepared. The head 2*p* is also referred to as a pre-line forming head. The pre-line forming head is an example of a pre-line forming member. As shown in FIG. 9, the head 2*p* is fixed with the face 4 horizontally set and faced upward. The head 2*p* is fixed by a jig, which is not shown.

In the step, the face line fa is formed by a cutter 12 which is axially rotated.

As shown in FIG. 9, the cutter 12 is fixed to a base part 14. The base part 14 is a part of an NC processing machine (abbreviated in FIG. 9). The cutter 12 is rotated together with the base part 14. A rotation axis rz of the cutter 12 is equal to a central axis line z1 of the cutter 12.

The cutter 12 is axially rotated. The cutter 12 is moved while the axial rotation is maintained. The cutter 12 is moved to a predetermined cut starting position (a position of an end of the face line) (see arrows of FIG. 9). Next, the cutter 12 descends (see an open arrow of FIG. 9). A position in the vertical direction of the cutter 12 during processing is determined according to the depth of the face line fa previously set. As described above, the depth of the face line fa is set to (D1+T1) (mm). Next, the cutter 12 is moved in the longitudinal direction (an almost toe-heel direction) of the face line (the arrow directions of FIG. 9). The movement follows a straight line. The face 4 is scraped during the movement to form the face line fa. Next, the cutter 12 ascends. The cutting is stopped after the ascending. Next, the cutter 12 is moved to a cut starting position of another face line fa. Hereinafter, these operations are repeated to process the plurality of face lines fa. The cutter 12 is moved based on a program memorized in the NC processing machine (not shown). The face line fa having the designed depth is formed at the designed position. The step (A) is completed on forming the face line fa.

The step (B) is carried out after the step (A). As described using FIG. 7, in the step (B), the cut processing is carried out along the plane PL1.

The method of the cut processing of the step (B) is not restricted. As a device which carries out the step (B), a milling machine and an NC processing machine are exemplified. In respect of processing accuracy, the step (B) is preferably carried out by the NC processing machine, more preferably a CNC processing machine. In the step (B), the flat land area LA is formed with sufficient accuracy. The face line fb shallower than the face line fa is formed in the step (B). In the step (B), a surface layer part having a thickness of T1 (mm) is scraped with sufficient accuracy. In the step (B), the shape near the point Pa tends to be set to the preferred shape. The suitable angle θ2 is applied in the step (B). The suitable angle θ2 can contribute to the enhancement in the spin performance and the suppression of the damage of the ball.

The other examples of the device which carries out cut processing of the step (B) include a polishing device provided with a support member having a plane part and a polishing belt supported by the plane part. In the polishing device, the face is forced on the plane part, whereby the polishing belt moved between the face and the support member polishes the face surface flatly. The polishing method is inferior to the NC processing machine in terms of polish accuracy. However, the polishing method is more preferable than the NC processing machine in terms of productivity.

A head obtained by combining a head body with a face plate has been known. In the head, the head body has an opening. The opening may be a recessed portion, or may be a through hole. The shape of the opening is equivalent to the contour shape of the face plate. In the head, the face plate is fitted into the opening. In the case of such a head, processing of the face line fa may be carried out in the state of the simple face plate. The face plate before the processing of the face line is carried out is an example of the pre-line forming member.

Figure 10:
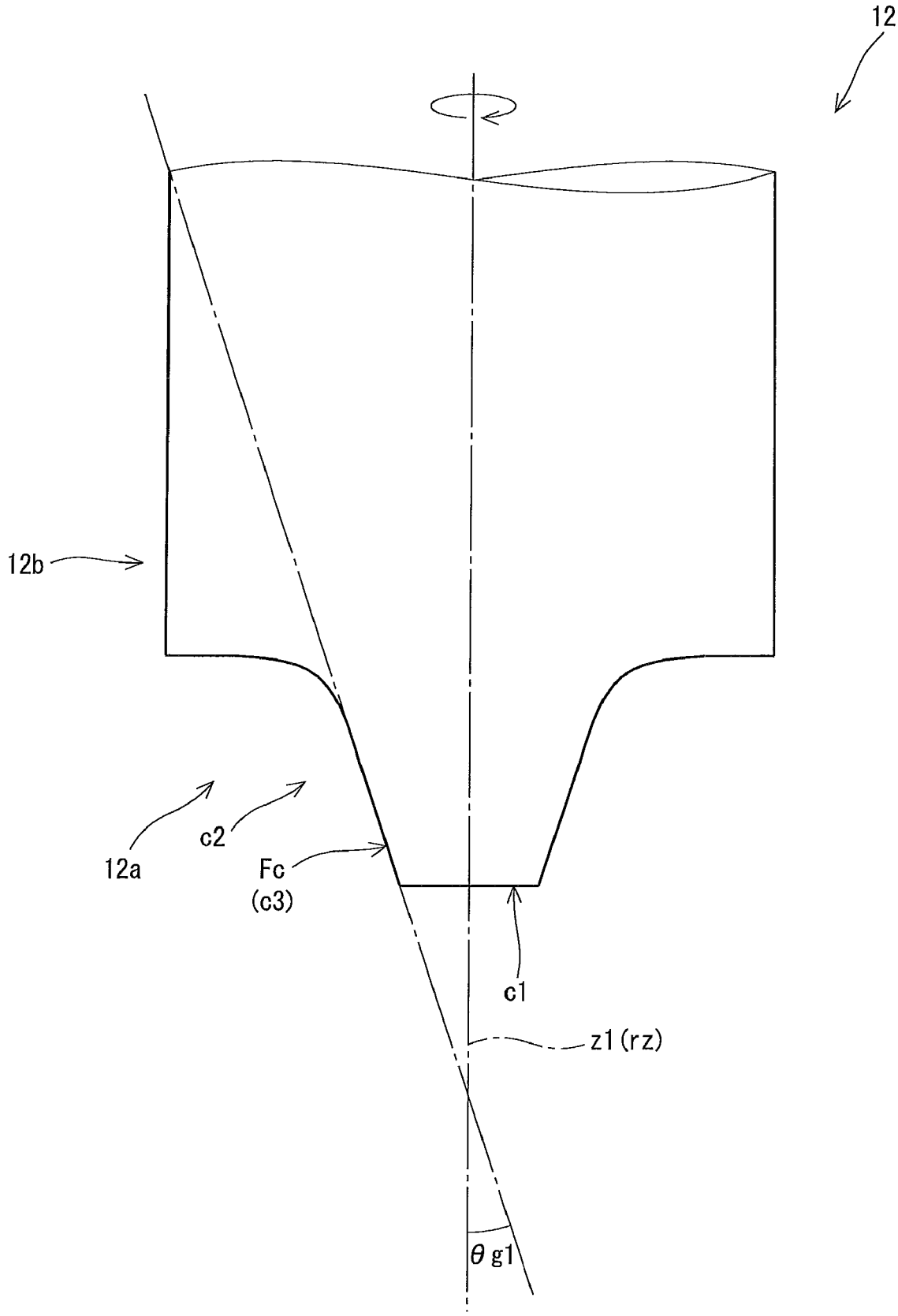
FIG. 10 is an enlarged view of a tip part of the cutter, and is an enlarged view of an inside of a circle F10 of FIG. 9.

FIG. 10 is an enlarged view of the tip part (see numeral character F10 in a circle of FIG. 9) of the cutter 12 which may be used in the step (A).

The cutter 12 has a cutting surface 12*a* and a base body 12*b*. The base body 12*b* has a cylindrical shape. At least a part of the cutting surface 12*a* abuts on the head. At least a part of the cutting surface 12*a* scrapes the head. Usually, a part of the cutting surface 12*a* scrapes the head. The base body 12*b* has a cylindrical shape.

The section of the cutting surface 12*a* in a section perpendicular to the central axis line z1 has a circular shape. The section shape of the cutting surface 12*a* formed by a plane including the central axis line z1 is equal to the shape of a side surface shown in FIG. 10.

As long as there is no especial explanation, "the section of the cutter" in the present application implies a section formed by a plane including the central axis line z1. As long as there is no especial explanation, "the section of the face line" in the present application implies a section formed by a plane perpendicular to the land area LA and perpendicular to the longitudinal direction of the face line. An example of "the section of the face line" in the present application is a section taken along a line III-III of FIG. 2.

Figure 11:
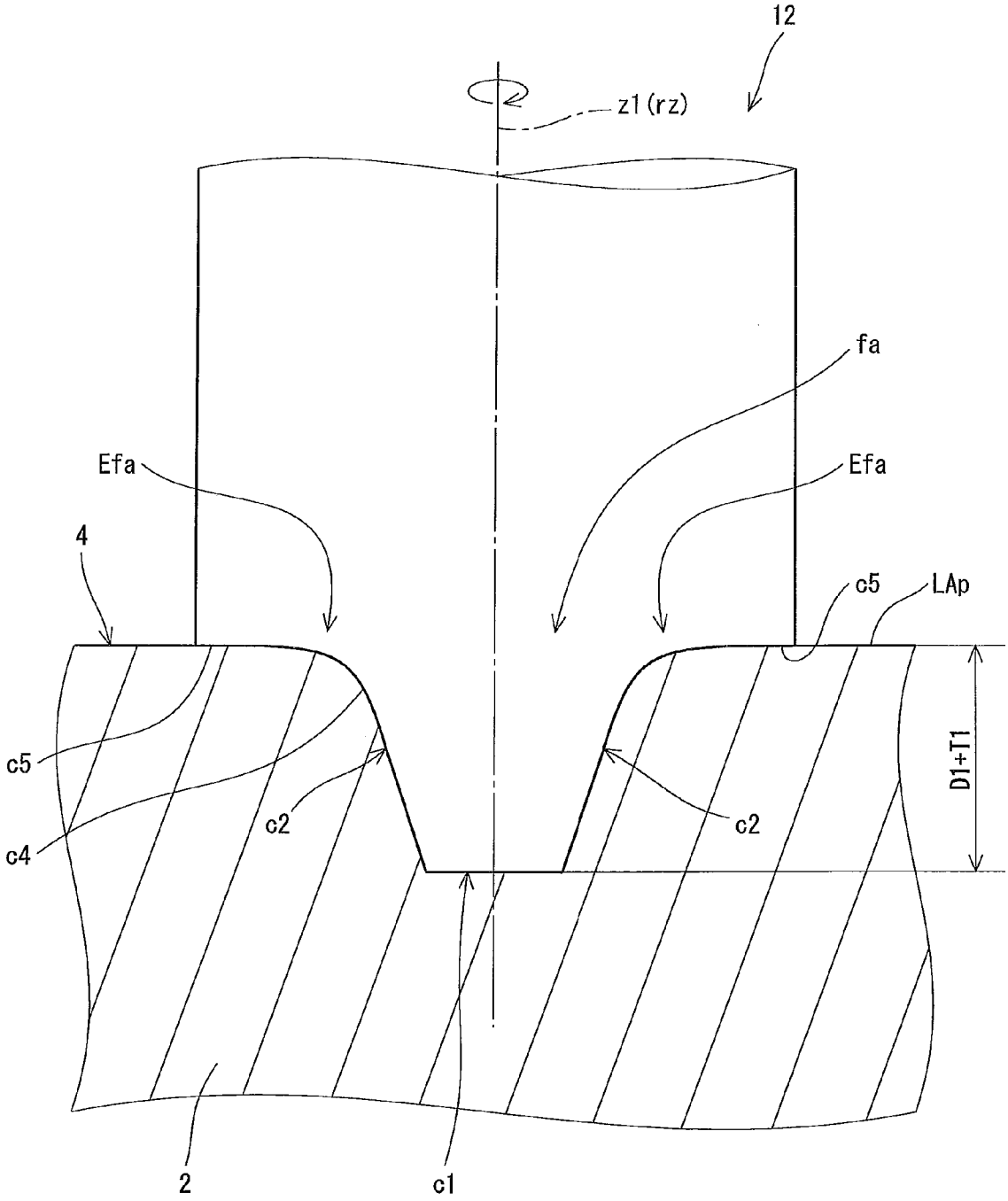
FIG. 11 is a diagram showing a condition in which cut processing is carried out by the cutter shown in FIG. 10.

FIG. 11 is a partial sectional view showing a condition during the cut processing. The face line fa having the section shape corresponding to the cutting surface 12*a* is formed by the cut processing. In the embodiment of FIG. 11, the central axis line z1 is perpendicular to the land area LAp.

As shown in FIG. 11, the bottom surface gc1 of the face line fa is scraped by the bottom surface c1. The plane inclined part gc3 of the face line fa is scraped by a conical surface Fc (first straight part c3). The protruded curved surface gc4 of the face line fa is scraped by the recessed curved surface c4.

In the embodiment of FIG. 11, in a direction of the central axis line z1 (a direction perpendicular to the land area LAp), the position of the land area LAp coincides with the position of the upper side plane part c5. In the embodiment of FIG. 11, the vertical position of the land area LAp coincides with the vertical position of the upper side plane part c5. The land area LAp is brought into surface-contact with the upper side plane part c5. The upper side plane part c5 is a reference for positioning the cutter 12. The cutter 12 is positioned so that the upper side plane part c5 abuts on the land area LAp. Unlike the embodiment of FIG. 11, a clearance may be formed between the upper side plane part c5 and the land area LAp. In this case, the cutter 12 is positioned based on the distance of the clearance. The upper side plane part c5 can enhance the position accuracy of the depth-directional position of the cutter 12. The upper side plane part c5 enables the processing of high accuracy. The embodiment will be described later.

Figure 12:
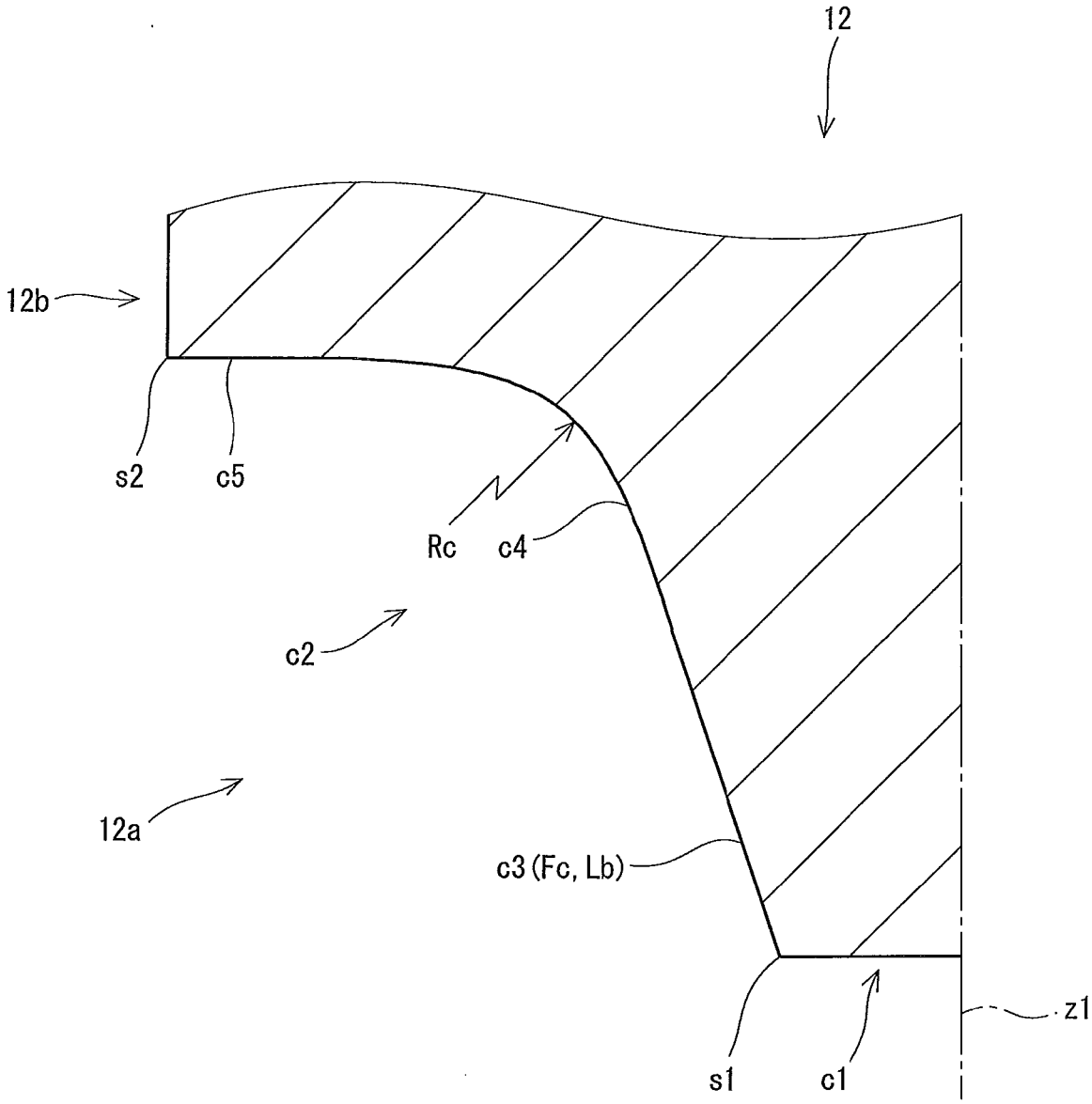
FIG. 12 is a partial sectional view of the cutter shown in FIG. 10.
Figure 13:
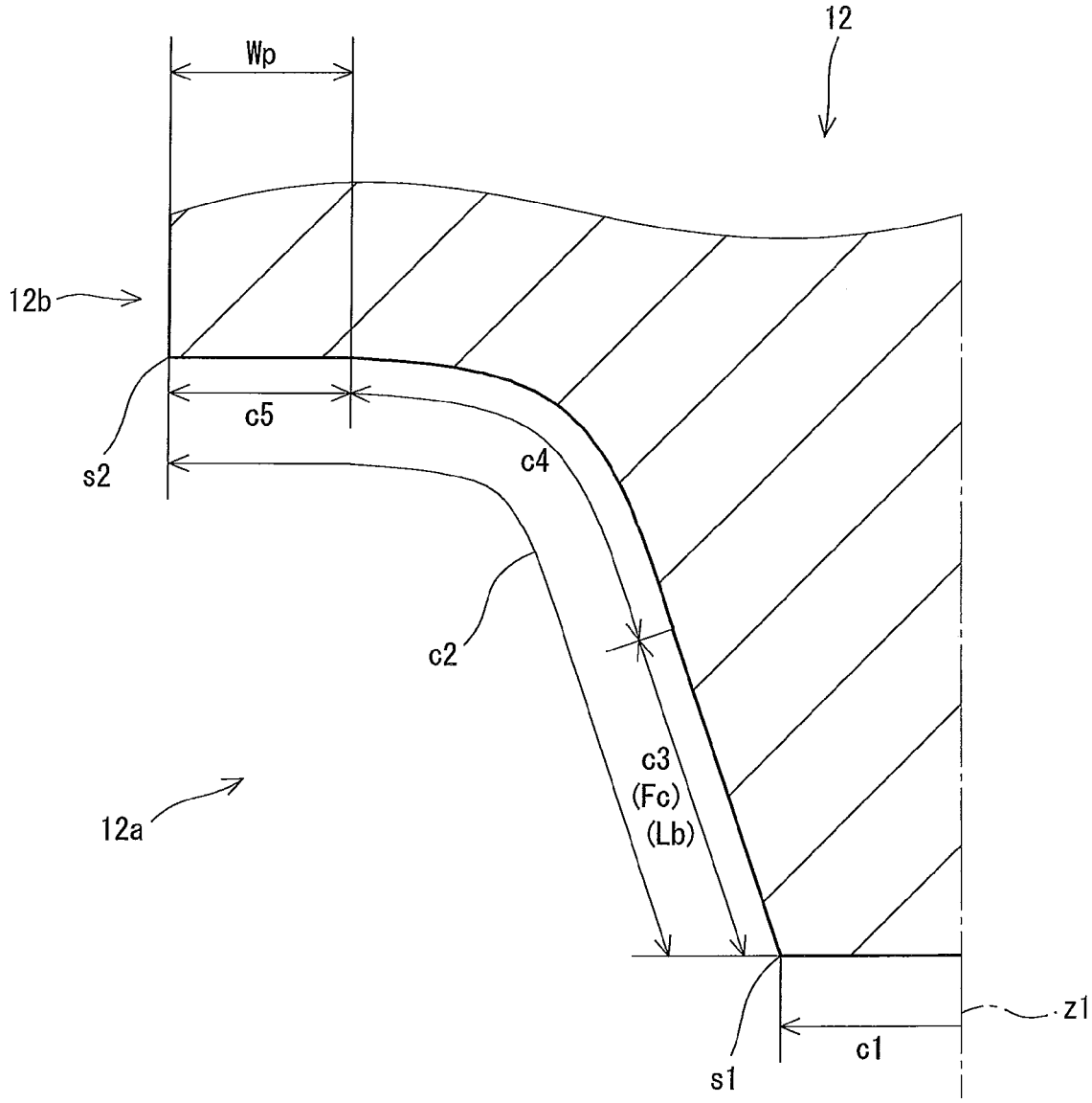
FIG. 13 is a partial sectional view of the cutter shown in FIG. 10 as in FIG. 12.

FIGS. 12 and 13 are sectional views of the tip part of the cutter 12. FIGS. 12 and 13 are sectional views formed by a plane including the central axis line z1. The sectional view of the cutter 12 is axisymmetric about the central axis line z1. Accordingly, only the left side of the central axis line z1 is shown in FIGS. 12 and 13.

As shown in FIGS. 12 and 13, the cutting surface 12*a* has a bottom surface c1 and a side surface c2. The side surface c2 is located between the base body 12*b* and the bottom surface c1. A boundary between the bottom surface c1 and the side surface c2 is a corner s1. A boundary between a side surface of the base body 12*b* and the side surface c2 is a corner s2.

As shown in FIG. 13, the side surface c2 has a first straight part c3, a curved line part c4, and a second straight part c5. In the cutter 12 of the embodiment, the bottom surface c1 is a plane. In the cutter 12, the bottom surface c1 is a circular plane. The plane is perpendicular to the central axis line z1. The shape of the bottom surface c1 is not restricted. The bottom surface c1 may be a curved surface. The bottom surface c1 may not be perpendicular to the central axis line z1. The bottom surface c1 may be an uneven surface. In respect of enlarging an area A1 (described later) of a transverse plane of the face line 8, the bottom surface c1 is preferably a plane, and more preferably a plane perpendicular to the central axis line z1.

The section of the first straight part c3 is a straight line. The first straight part c3 is a conical surface Fc. The first straight part c3 is a conical protruded surface. The section line of the conical surface Fc is a straight line. The section line of the conical surface Fc is a generating line Lb of the conical surface Fc. The boundary between the conical surface Fc and the bottom surface c1 is the corner s1. In the embodiment, the corner s1 has no roundness. The corner s1 may have a roundness.

The first straight part c3 is also referred to as the conical surface Fc. The conical surface Fc may not be formed. For example, the entire side surface c2 may be the curved line part c4. Comprehensively considering the manufacturing cost of the cutter, the cost of the cut processing, the securement of the area A1 (described later) of the transverse plane of the groove, and the conformity to the golf rules, it is preferable that the conical surface Fc is formed.

The curved line part c4 is a recessed surface. The recessed surface is a recessed curved surface. The entire recessed curved surface is smoothly continuously formed. The curved line part c4 is also referred to as a recessed curved surface c4. The section of the recessed curved surface c4 is a curve. The shape of the curve is recessed. In other words, the shape of the curve is a protruded shape toward the central axis line z1.

In the preferred step (B), a cutter having the recessed curved surface c4 is used. The protruded curved surface gc4 is formed by the recessed curved surface c4. The cut processing using the recessed curved surface c4 forms the protruded curved surface gc4. The section shape of the recessed curved surface c4 corresponds to the section shape of the protruded curved surface gc4. The protruded curved surface gc4 has the curvature radius Rc corresponding to the curvature radius Ra described above.

The face line fa having the edge Ex having a roundness can be produced with sufficient accuracy by the cut processing using the cutter 12

The second straight part c5 is a plane. The second straight part c5 is also referred to as an upper side plane part c5. The upper side plane part c5 is a plane part of an upper end of the side surface c2. The upper side plane part c5 is a plane perpendicular to the central axis line z1. The upper side plane part c5 is an annular plane. The upper side plane part c5 is located between the surface of the base body 12*b* and the recessed curved surface c4. The boundary between the surface of the base body 12*b* and the upper side plane part c5 is the corner s2 (see FIG. 13).

The conical surface Fc and the recessed curved surface c4 are smoothly continuously formed. The recessed curved surface c4 and the upper side plane part c5 are smoothly continuously formed. The entire side surface c2 is smoothly continuously formed. The side surface c2 may have a portion which is not smoothly continuously formed.

A width of the upper side plane part c5 is shown by a double-pointed arrow Wp in FIG. 13. The width Wp is measured along the radial direction of the cutter 12. In respect of the processing accuracy, the width Wp is preferably equal to or greater than 0.1 mm, and more preferably equal to or greater than 0.3 mm. In respect of reducing the manufacturing cost of the cutter 12, the width Wp is preferably equal to or less than 5 mm, more preferably equal to or less than 3 mm, and still more preferably equal to or less than 1 mm.

The upper side plane part c5 may not be present. As described above, in respect of the processing accuracy, it is preferable that the upper side plane part c5 is present.

The edge Efa of the face line fa is formed as a smooth curved surface by cut processing with the upper side plane part c5 abutting on the land area LAp (see FIG. 7).

The face line fb having the suitable angle θ2 and radius R3 can be formed by carrying out the step (B) after the step (A) using the cutter 12.

An angle between the central axis line z1 and the conical surface Fc (first straight part c3) is shown by θg1 in FIG. 10. The angle θg1 is measured in a section formed by a plane containing the central axis line z1. In the present application, the angle θg1 is also referred to as an cutter angle.

In respect of setting the groove angle θ1 to the preferred value, the cutter angle θg1 is preferably equal to or less than 30 degrees, more preferably equal to or less than 25 degrees, and still more preferably equal to or less than 20 degrees. In respect of setting the groove angle θ1 to the preferred value, the cutter angle θg1 is preferably equal to or greater than 1 degree, more preferably equal to or greater than 3 degrees, and still more preferably equal to or greater than 5 degrees.

The manufacturing method of the head of the present invention may not include the steps (A) and (B). Hereinafter, the other manufacturing method other than the manufacturing method described above will be described.

Figure 14:
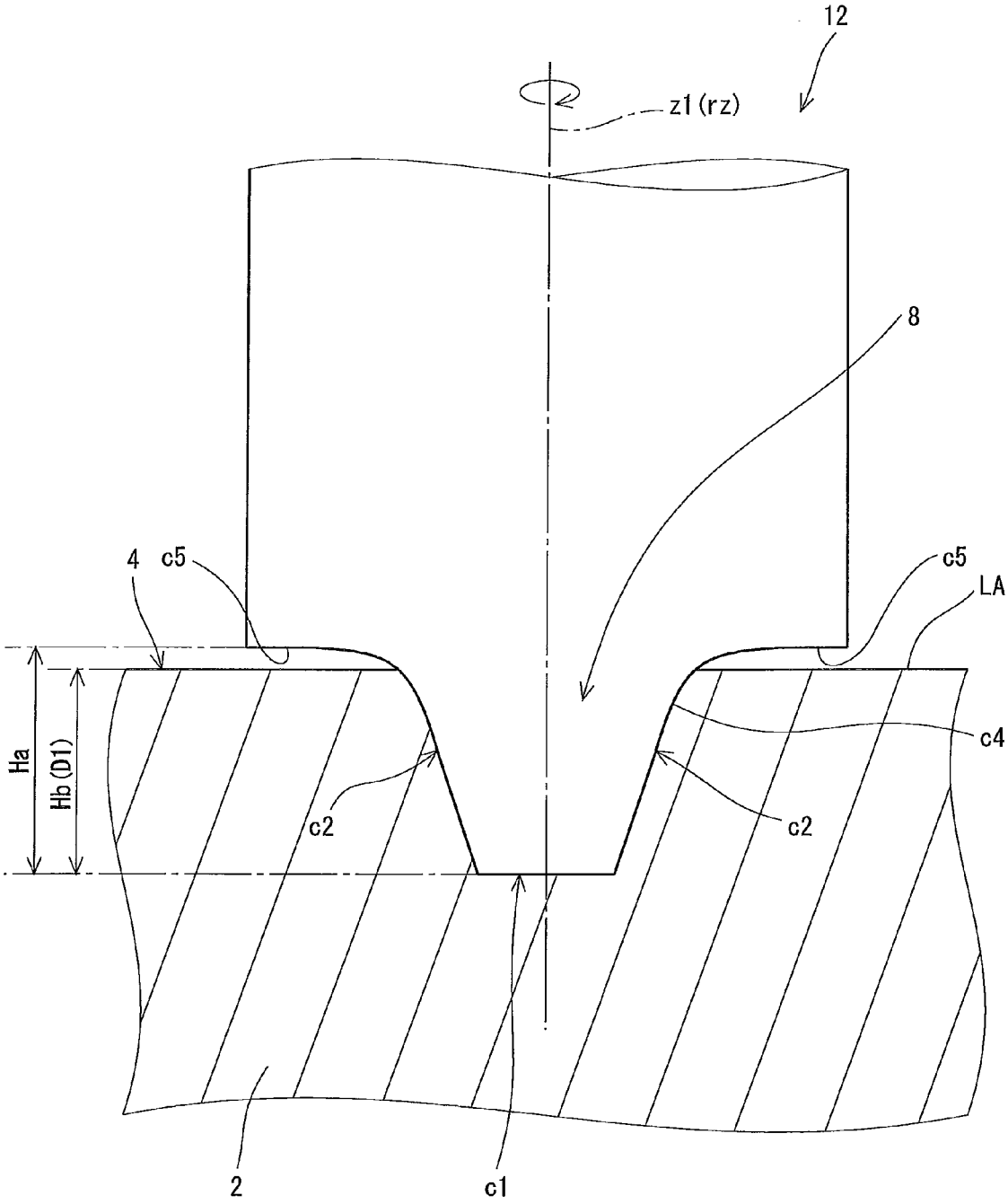
FIG. 14 is a diagram for explaining one example of a manufacturing method according to another embodiment.

FIG. 14 is a partial sectional view showing a condition in which the other manufacturing method is conducted. The step (B) can be abbreviated in the manufacturing method.

Figure 15:
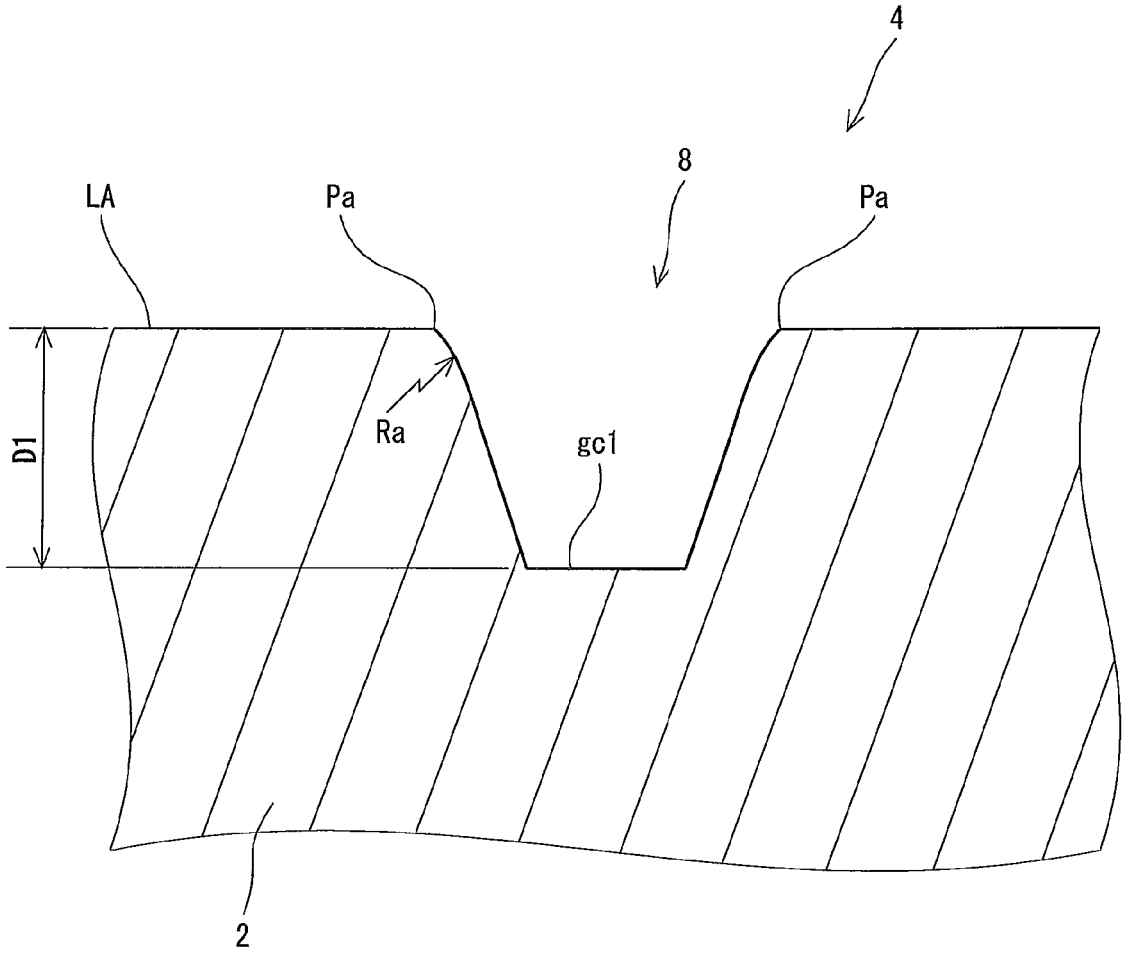
FIG. 15 is a sectional view of a face line processed in the embodiment of FIG. 14.

In the embodiment of FIG. 14, the central axis line z1 is perpendicular to the land area LA. FIG. 15 is a sectional view of the face line 8 formed in the embodiment of FIG. 14.

The cutter 12 described above is used in the manufacturing method. A cutter having the other shape may be used.

In the embodiment of FIG. 14, the clearance is present between the upper side plane part c5 and the land area LA. The distance of the clearance is (Ha-Hb) (see FIG. 14). The distance (Ha-Hb) can serve as the reference for positioning the cutter 12. The upper side plane part c5 is effective as the reference for positioning. The setting can enhance the processing accuracy of the face line 8.

In the manufacturing method, for example, the difference (Ha-Hb) is set to T1 (mm), and a distance Hb is set to D1 (mm). In this case, the face line having the same shape as that of the embodiment of FIG. 3 can be obtained without carrying out the step (B). The manufacturing method is preferable in respect of the simplification of the step. However, in respect of the accuracy of the shape of the face line, the manufacturing method including the steps (A) and (B) described above is preferable. Naturally, the step (B) may be carried out after the embodiment of FIG. 14.

In addition to the embodiment of the FIG. 14, the section shape of the cutter may be the same shape as that of the section line of FIG. 3 or FIG. 15. Also in this case, the face line having the section shape as shown in FIG. 15 or FIG. 3 can be obtained by only the cut processing of the face line without carrying out the step (B). However, in respect of the accuracy of the shape of the face line, the manufacturing method which includes the steps (A) and (B) described above is preferable.

A groove width is shown by a double-pointed arrow W1 in FIG. 8. A groove distance is shown by a double-pointed arrow S1 in FIG. 8. An area of a transverse plane of the groove is shown by A1 in FIG. 8. The area A1 of the transverse plane of the groove is an area of a region shown by hatching of a one-dotted chain line.

The groove width W1 and the groove distance S1 are measured based on the golf rules defined by R&A (Royal and Ancient Golf Club of Saint Andrews). The measuring method is referred to as "30 degree method of measurement". The 30 degree method of measurement determines contact points CP1 and CP2 of a tangent having an angle of 30 degrees with respect to the land area LA and a groove. A distance between the contact point CP1 and the contact point CP2 is defined as the groove width W1 (see FIG. 8). A distance between the contact point CP2 of the groove 81 and the contact point CP1 of a groove 82 next to the groove 81 is defined as the groove distance S1 (see FIG. 8).

The groove depth D1 described above is a distance between an extended line La of the land area LA and the lowest point of the groove section line (see FIG. 8).

The groove area A1 is an area of a portion surrounded by the extended line La and the profile (section line) of the groove.

The golf rules related to the face line, including the new rules scheduled to be effected from Jan. 1, 2010 were announced from R&A (Royal and Ancient Golf Club of Saint Andrews) on Aug. 5, 2008. The Japanese translation of the rules of the face line is placed in the homepage of JGA (Japan Golf Association). The address of the JGA homepage in which the Japanese translation is posted is "http://www.j-ga.or.jp/jga/html/jga_data/04KISOKU_NEWS/2008_KISOKU/GrooveMeasurementProcedureOutline(JP).pdf". The rules are described in English in the rulebook (the 2009 edition) published by R&A (Royal and Ancient Golf Club of Saint Andrews) or the homepage of R&A. In the present application, the golf rules imply the rules defined by the R&A.

In respect of improving the dischargeability of water to enhance the spin performance, the groove width W1 is preferably equal to or greater than 0.3 (mm), more preferably equal to or greater than 0.4 (mm), and still more preferably equal to or greater than 0.5 (mm). In respect of increasing the contact surface of the ball and the face surface at impact to enhance the spin performance, the groove width W1 is preferably equal to or less than 0.9 (mm), more preferably equal to or less than 0.8 (mm), and still more preferably equal to or less than 0.7 (mm).

It is preferable that the groove distance S1 is set in consideration of the conformity to the golf rules. In respect of the conformity to the rules, it is preferable that a value obtained by dividing the area A1 by a groove pitch Pt1 is equal to or less than 0.003 square inches/inch (0.0762 $mm^2$/mm). In respect of the conformity to the rules, it is preferable that the groove distance S1 is equal to or greater than three times the groove width W1.

The groove pitch Pt1 is shown in FIG. 8. The groove pitch Pt1 is equal to the sum of the groove width W1 and the distance S1.

The groove pitch Pt1 is not restricted. In respect of increasing the contact surface of the ball and the face surface at impact to enhance the spin performance, the groove pitch Pt1 is preferably equal to or greater than 2.5 (mm), more preferably equal to or greater than 3.0 (mm), and still more preferably equal to or greater than 3.3 (mm). In respect of the effect caused by the groove, particularly the spin performance in the wet condition, the groove pitch Pt1 is preferably equal to or less than 4.4 (mm), more preferably equal to or less than 4.1 (mm), and still more preferably equal to or less than 3.8 (mm).

The area A1 is not restricted. In respects of the dischargeability of water and the spin performance in the wet condition, the area A1 is preferably equal to or greater than 0.08 ($mm^2$), more preferably equal to or greater than 0.09 ($mm^2$), and still more preferably equal to or greater than 0.1 ($mm^2$). In respect of suppressing entry of earth, mud, or sand, the area A1 is preferably equal to or less than 0.45 ($mm^2$), more preferably equal to or less than 0.40 ($mm^2$), and still more preferably equal to or less than 0.38 ($mm^2$).

A distance between the center of the circle CL1 and the land area LA is shown by a double-pointed arrow L1 in FIG. 6. In respect of suppressing the damage of the ball, a ratio (L1/R3) of the distance L1 (mm) to the radius R3 (mm) is preferably equal to or greater than 0.76, more preferably equal to or greater than 0.78, and still more preferably equal to or greater than 0.80 (mm). In respect of the spin performance, the ratio (L1/R3) is preferably equal to or less than 0.91, more preferably equal to or less than 0.89, and still more preferably equal to or less than 0.87.

The groove depth D1 is not restricted. In respect of the processability of the groove, the groove depth D1 (mm) is preferably equal to or less than 0.50 (mm), more preferably equal to or less than 0.45 (mm), and still more preferably equal to or less than 0.40 (mm). When the groove depth D1 is excessively small, the area A1 (described later) of the transverse plane of the groove is reduced. When the area A1 is excessively small, the amount of mud or grass (lawn grass) which can escape into the groove is reduced, whereby the spin performance may be reduced. In this respect, the groove depth D1 is preferably equal to or greater than 0.20 (mm), more preferably equal to or greater than 0.25 (mm), and still more preferably equal to or greater than 0.30 (mm).

An arithmetic average roughness Raf of the land area LA is not restricted. In respect of the spin performance, the arithmetic average roughness Raf is preferably equal to or greater than 0.20 μm, more preferably equal to or greater than 0.25 μm, and still more preferably equal to or greater than 0.30 μm. In respect of suppressing the damage of the ball, the arithmetic average roughness Raf is preferably equal to or less than 0.55 μm, more preferably equal to or less than 0.50 μm, and still more preferably equal to or less than 0.45 μm. The arithmetic average roughness Raf is measured based on JIS B0601-1994. An example of methods for adjusting the arithmetic average roughness Raf is the shot-blasting treatment described above.

The real loft angle of the head is not restricted. The present invention is particularly effective in a head having a great backspin rate. In this respect, the real loft angle of the head is preferably equal to or greater than 30 degrees, more preferably equal to or greater than 35 degrees, and still more preferably equal to or greater than 40 degrees. In respect of the flight distance, the real loft angle is preferably equal to or less than 70 degrees, more preferably equal to or less than 65 degrees, and still more preferably equal to or less than 60 degrees.

EXAMPLES

Hereinafter, the effects of the present invention will be clarified by examples. However, the present invention should not be interpreted in a limited way based on the description of the examples.

Example 1

A head of PW (pitching wedge) of "SRIXON ZR-700" (trade name) manufactured by SRI Sports Limited was used. The step (A) and the step (B) were carried out on the head to form face lines. The step (A) was carried out in the embodiment shown in FIG. 11 using the same cutter as the cutter 12. ACNC processing machine was used in the step (A). Next, the step (B) (plane cut processing) was carried out. The CNC processing machine was used in the step (B). The real loft angle of the head was 46 degrees.

The face lines were disposed as shown in FIGS. 1 and 2. A distance Ed (see FIG. 2) between the heel side end of the non-longest line and the edge of a face was set to 5 mm. The shortest distance between a heel side end Bh1 (see FIG. 2) of the face line closest to a sole and a leading edge Le was set to 2 mm. The shortest distance between a toe side end Bt1 (see FIG. 2) of the face line closest to the sole and the leading edge Le was set to 2 mm. The shortest distance between a center position Ac1 in a longitudinal direction of the face line closest to the sole and the leading edge Le was set to 4.5 mm. A distance Ky (see FIG. 2) between a point Tt1 closest to the toe side on a face surface and a straight line Lt1 was set to 17 mm.

The section shape of the face line was measured. "INFINITE FOCUS optical 3D Measurement Device G4f" (trade name) manufactured by Alicona Imaging GmbH was used for the measurement. The shape of the face line was measured along a direction perpendicular to the longitudinal direction of the face line. The section shape was measured at the center position of the longest line as in the position of line of FIG. 2.

Fourteen face lines were measured. As a result, fourteen section lines were obtained. The average value of fourteen data obtained from the section lines is shown in the following Table 1. A groove width W1 and a groove depth D1 were determined according to the golf rules described above. A radius R3 was 0.26 (mm). A groove angle θ1 was 10 degrees. The distance L1 was set to 0.22 (mm). The groove depth D1 was 0.40 (mm). An arithmetic average roughness Raf was set to 0.23. The arithmetic average roughness Raf was adjusted by shot blasting.

A shaft and a grip were mounted to the head to obtain a golf club according to example 1. The length of the golf club was 35.5 inches. The backspin rate and the damage of the ball (damage applied to the ball) of the golf club were evaluated. The specification and the evaluation result of example 1 are shown in the following Table 1.

Examples 2 and 3

Heads of examples 2 and 3 were obtained in the same manner as in the example 1 except that the shape of the cutter and/or the distance T1 (mm) were changed and the shape of the groove was set so as to satisfy values shown in Table 1. Clubs of the examples 2 and 3 were obtained in the same manner as in the example 1 using the heads. These specifications and evaluation results are shown in the following Table 1.

Comparative Examples 1 and 3

Heads of comparative examples 1 and 3 were obtained in the same manner as in the example 1 except that the shape of the cutter was changed and the shape of the groove was set so as to satisfy values shown in Table 1. Clubs of the comparative examples 1 and 3 were obtained in the same manner as in the example 1 using the heads. These specifications and evaluation results are shown in the following Table 1. In the comparative examples 1 and 3, face lines were formed by only the groove processing using the cutter, and plane cut processing of the step (B) was not carried out.

Comparative Example 2

Figure 16:
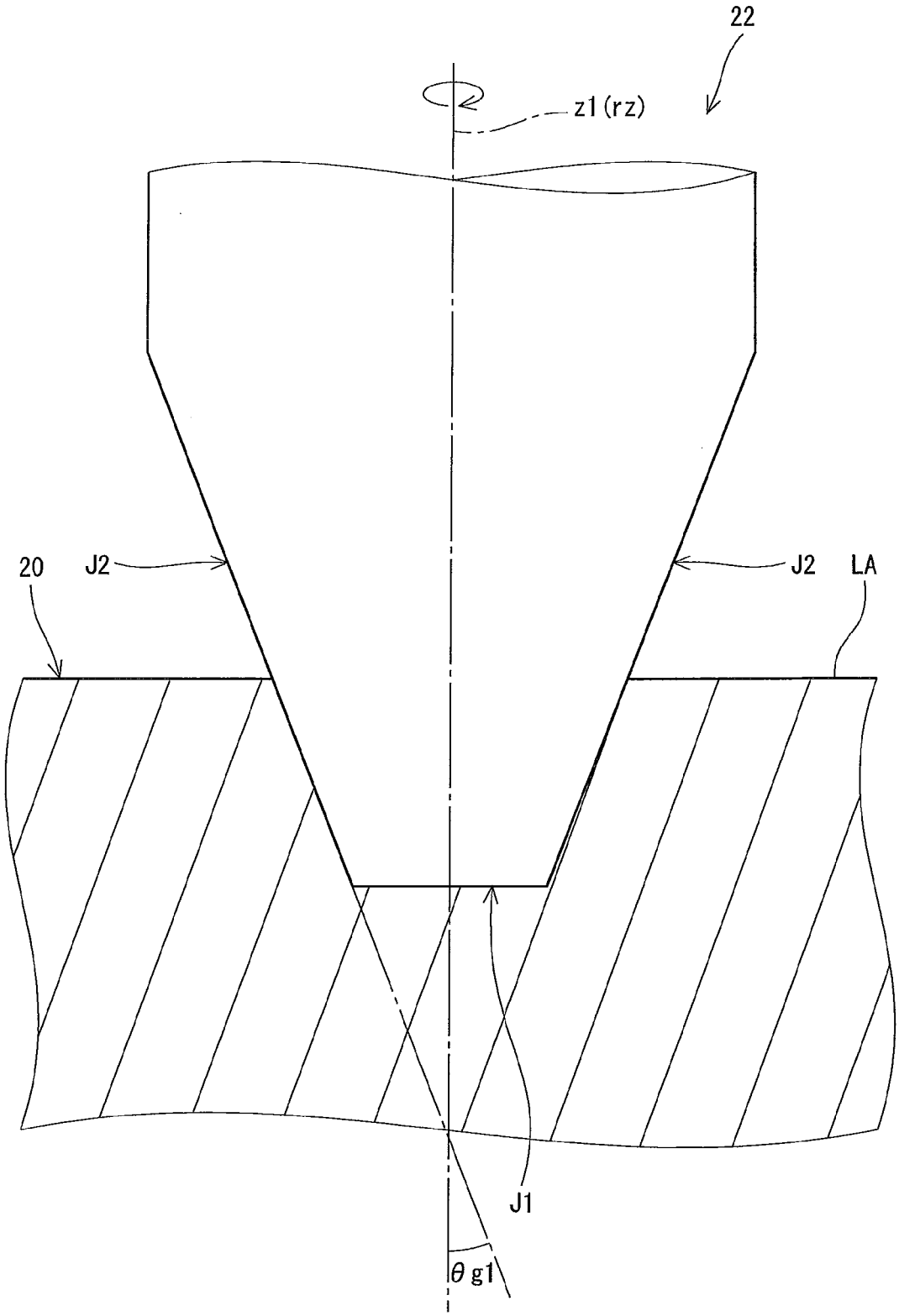
FIG. 16 is a diagram for explaining a processing method of a face line in comparative example 2.
Figure 17:
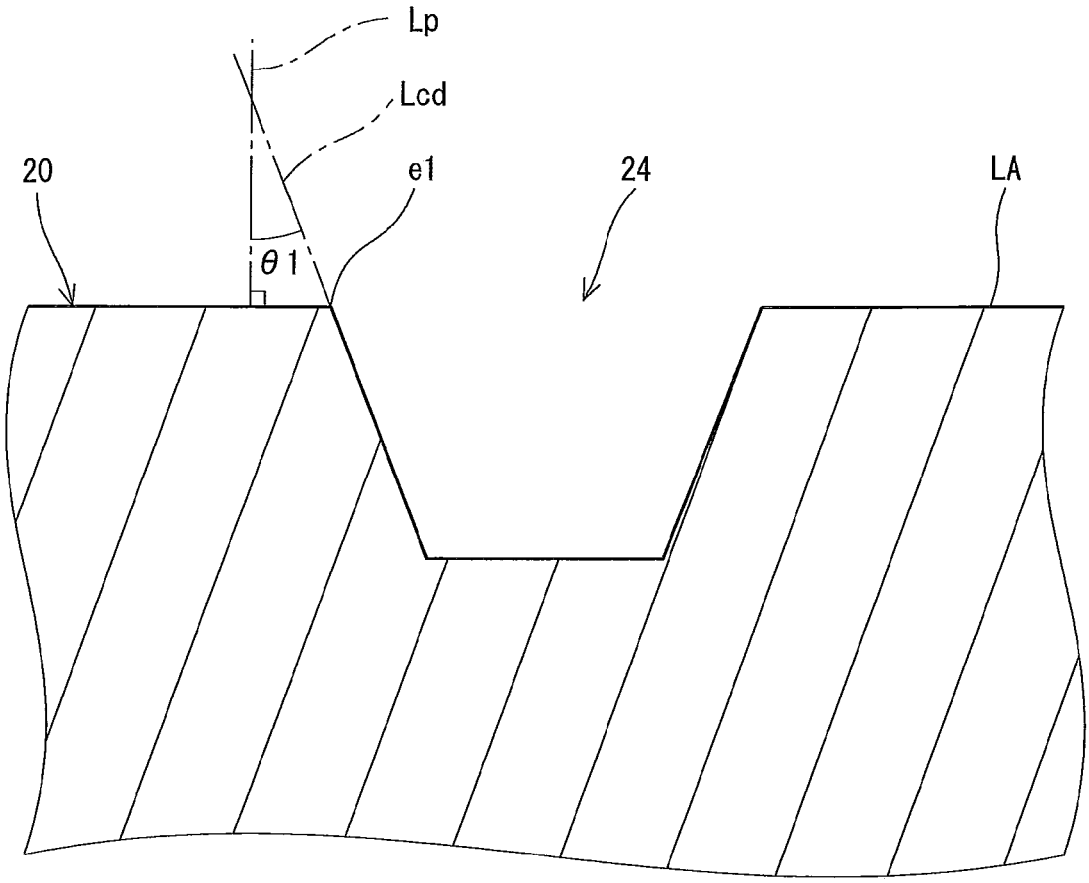
FIG. 17 is a sectional view of the face line of the comparative example 2.

FIG. 16 is a diagram showing a condition of cutting processing of face lines in comparative example 2. FIG. 16 is a partial sectional view showing a condition in which a face line 24 is formed on a face 20 by cut processing. In the comparative example 2, the cutting surface of a cutter 22 has no recessed curved surface. The cutting surface of the cutter 22 has a bottom surface J1 and a conical surface J2. The cutting surface of the cutter 22 is constituted by only the bottom surface J1 and the conical surface J2. The bottom surface J1 is a circular plane. The central axis line z1 of the cutter 22 passes through the center of the bottom surface J1. The bottom surface J1 is a plane perpendicular to the central axis line z1. The section shape of the conical surface J2 is a straight line. The straight line is a generating line of the conical surface J2. In the cutter 22, an cutter angle θg1 was set to 10 degrees. A face line 24 according to the comparative example 2 was obtained by cut processing using the cutter 22. FIG. 17 is a sectional view of the face line 24 of the comparative example 2. The specification and the evaluation result of the comparative example 2 are shown in the following table 1.

A valuation method is as follows. In the following evaluations, "SRIXON Z-STAR" (trade name) which was manufactured by SRI Sports Limited and was a three-piece ball was used.

[Backspin Rate]

Each of ten testers having a handicap of 0 to 9 hit balls placed on a semi-rough with a full shot, and a backspin rate immediately after hitting was measured. The length of the grass of the semi-rough was about 25 (mm). The backspin rate was measured using "TrackMan" (trade name) manufactured by ISG A/S in Denmark.

One tester hit balls thirty times per each of the clubs. The average value of the backspin rates of all hit balls (total number of data: 300) is shown in the following Table 1. The average value is rounded off to the nearest ten. As the backspin rate is greater, the spin performance is good.

[Evaluation of Ball Damage]

The damage of each of the balls hit by the ten testers was confirmed. The damage of the ball was visually confirmed per each of shots. The degree of the damage of the ball was evaluated in five steps of point 5, point 4, point 3, point 2, and point 1. A case where the most intense damage was observed was defined as point 5. A case where the fewest damage was observed was defined as point 1. The average value (rounded off to the nearest whole number) of evaluating points is shown in the following Table 1.

TABLE 1

Specifications and Evaluation Results of Examples and Comparative Examples

| | Example 1 | Example 2 | Example 3 | Comparative Example 1 | Comparative Example 2 | Comparative Example 3 |
|---|---|---|---|---|---|---|
| Radius R3 (mm) | 0.26 | 0.30 | 0.26 | 0.26 | Infinity | 0.20 |
| L1 (mm) | 0.22 | 0.25 | 0.23 | 0.26 | — | 0.20 |
| L1/R3 | 0.85 | 0.83 | 0.88 | 1.00 | — | 1.00 |
| Groove depth D1 (mm) | 0.40 | 0.40 | 0.40 | 0.40 | 0.40 | 0.40 |
| Groove width W1 (mm) | 0.80 | 0.80 | 0.80 | 0.80 | 0.80 | 0.80 |
| Angle q1 (degree) | 10 | 10 | 10 | 10 | 10 | 10 |
| Groove pitch Pt1 (mm) | 3.60 | 3.60 | 3.60 | 3.60 | 3.60 | 3.60 |
| Angle q2 (degree) | 32 | 34 | 28 | 7 | 80 | 8 |
| Area A1 ($mm^2$) | 0.28 | 0.26 | 0.28 | 0.27 | 0.29 | 0.28 |
| Arithmetic average roughness Raf of land area (mm) | 0.23 | 0.23 | 0.23 | 0.23 | 0.23 | 0.23 |
| Backspin amount (rpm) | 6800 | 6820 | 6730 | 6300 | 6940 | 6550 |
| Evaluating point of ball damage | 2 | 2 | 1 | 1 | 5 | 3 |

As shown in Table 1, the examples are highly evaluated as compared with the comparative examples. From the evaluation results, the advantages of the present invention are apparent.

The present invention can be applied to all the golf club heads provided with the face lines. The present invention can be used for an iron type golf club head, a wood type golf club head, a utility type golf club head, a hybrid type golf club head, a putter type golf club head, or the like.

The description hereinabove is merely for an illustrative example, and various modifications can be made in the scope not to depart from the principles of the present invention.

What is claimed is:

1. A golf club head comprising:

a face line having a depth of D1 (mm); and a land area, wherein when a boundary between the land area and the face line is defined as a point Pa in a section line of a surface of a face; a point of which a depth is [D1/4] (mm) is defined as a point Pb; a point of which a depth is [D1/2] (mm) is defined as a point Pc; a point of which a depth is [(D1)×(¾)] (mm) is defined as a point Pd; a point of which a depth is 0.002 (mm) is defined as a point Px; a radius of a circle CL1 passing through three points of the point Pa, the point Pb, and the point Pc is defined as R3 (mm); a straight line passing through the point Pa and the point Px is defined as a straight line Lax; and an angle between the land area and the straight line Lax is defined as θ2 (degree), the radius R3 is 0.2 (mm) or greater and 0.4 (mm) or less, and the angle θ2 is 10 degrees or greater and 50 degrees or less.

2. The golf club head according to claim 1, wherein when a distance between a center of the circle CL1 and the land area LA is defined as L1 (mm), a ratio (L1/R3) is 0.76 or greater and 0.91 or less.

3. The golf club head according to claim 1, wherein the golf club head is manufactured by a manufacturing method comprising the steps of:

(A) forming a face line fa having a depth of (D1+T1) (mm); and (B) carrying out cut processing along a plane PL1 placed at a position of which a depth is T1 (mm) to form a face line fb having a depth of D1 (mm), wherein an edge of the face line fa includes a protruded curved surface;

the plane PL1 crosses the protruded curved surface; and an intersection line of the plane PL1 and the protruded curved surface is a set of the points Pa.

4. The golf club head according to claim 1, wherein an angle θ1 between a straight line Lcd passing through the point Pc and the point Pd and a straight line Lp perpendicular to the land area is 1 degree or greater and 30 degrees or less.

5. The golf club head according to claim 1, wherein a curvature radius Ra at each of points between the point Pa and the point Pb is gradually increased as approaching to the point Pa, and a straight line portion is not included between the point Pa and the point Pb.

6. The golf club head according to claim 1, wherein a curvature radius at each of points between the point Pa and the point Pc is constant.

7. The golf club head according to claim 1, wherein only a curved line is included between the point Pa and the point Pc.

8. The golf club head according to claim 1, wherein a straight line is included between the point Pa and the point Pc.

9. The golf club head according to claim 1, wherein a straight line is included between the point Pb and the point Pc.

10. The golf club head according to claim 1, wherein a straight line is included between the point Pc and the point Pd.

11. The golf club head according to claim 1, wherein only a straight line is included between the point Pc and the point Pd.

12. The golf club head according to claim 1, wherein at least one of a straight line and/or a curved line is smoothly continuously formed between the point Pa and the point Pd.

13. The golf club head according to claim 3, wherein the step (A) is carried out by a cutter which is axially rotated;

the cutter has a cutting surface;

the cutting surface has a bottom surface and a side surface; and the side surface has an upper side plane part.

14. The golf club head according to claim 13, wherein a width Wp of the upper side plane part is 0.1 mm or greater and 5 mm or less.

15. The golf club head according to claim 1, wherein the radius R3 is equal to or greater than 0.23 (mm).

16. The golf club head according to claim 1, wherein the radius R3 is equal to or greater than 0.26 (mm).

17. The golf club head according to claim 1, wherein the angle θ2 is equal to or greater than 25 degrees.

18. The golf club head according to claim 1, wherein the angle θ2 is equal to or greater than 28 degrees.

19. The golf club head according to claim 2, wherein the ratio (L1/R3) is equal to or greater than 0.78.

20. The golf club head according to claim 2, wherein the ratio (L1/R3) is equal to or greater than 0.80.

21. The golf club head according to claim 2, wherein the ratio (L1/R3) is equal to or less than 0.89.

* * * * *